US008196417B2

(12) United States Patent
Kim et al.

(10) Patent No.: US 8,196,417 B2
(45) Date of Patent: Jun. 12, 2012

(54) REFRIGERATOR

(75) Inventors: Dong-Kyu Kim, Pohang-si (KR); Kyung-Dae Hwang, Changwon-si (KR); Jin-Hyun Kim, Incheon-si (KR); Hyuk-Soon Kim, Seoul (KR); Seung-Beom Chae, Gangneung-si (KR); Hyun-Tae Lee, Changwon-si (KR); Joo-Shin Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 881 days.

(21) Appl. No.: 12/094,760

(22) PCT Filed: Nov. 23, 2006

(86) PCT No.: PCT/KR2006/004954

§ 371 (c)(1),
(2), (4) Date: Oct. 14, 2008

(87) PCT Pub. No.: WO2007/061238

PCT Pub. Date: May 31, 2007

(65) Prior Publication Data

US 2009/0217694 A1 Sep. 3, 2009

(30) Foreign Application Priority Data

Nov. 23, 2005 (KR) ..... 10-2005-0112617
Nov. 23, 2005 (KR) ..... 10-2005-0112618
Nov. 23, 2005 (KR) ..... 10-2005-0112619
Nov. 23, 2005 (KR) ..... 10-2005-0112620
Nov. 23, 2005 (KR) ..... 10-2005-0112621

(51) Int. Cl.
*F24F 3/16* (2006.01)

(52) U.S. Cl. ..... 62/78; 62/515

(58) Field of Classification Search ..... 62/26, 78, 62/449, 515; 426/43, 38, 57, 61, 234, 305; 38/26, 78, 449, 515
See application file for complete search history.

(56) References Cited

U.S. PATENT DOCUMENTS 2,765,046 A 10/1956 Rondholz
4,942,032 A 7/1990 Vandenbergh et al.
5,186,962 A 2/1993 Hutkins et al.
5,392,615 A * 2/1995 Lim ..... 62/414
(Continued)

FOREIGN PATENT DOCUMENTS

DE 202 14 601 U1 1/2003
(Continued)

OTHER PUBLICATIONS

Translation of JP 10-132447 to Sumida et al of an Ids enclosed by the Applicants.*

*Primary Examiner* — Mohammad Ali
(74) *Attorney, Agent, or Firm* — Birch, Stewart, Kolasch & Birch, LLP

(57) ABSTRACT

The present invention relates to a refrigerator, including: a refrigerating cycle having an evaporator (1*a*); a space for exchanging heat with the evaporator; a region for exchanging heat between the evaporator and the space; and a storage chamber and a door for defining the space, wherein at least one of the region, the storage chamber and the door has undergone at least one of a Kimchi lactic acid bacteria culture treatment and a Kimchi lactic acid bacteria culture exposure treatment.

17 Claims, 9 Drawing Sheets

U.S. PATENT DOCUMENTS

| | | | | |
|---|---|---|---|---|
| 5,468,454 | A * | 11/1995 | Kim | 422/121 |
| 6,756,066 | B2 * | 6/2004 | Jeong et al. | 426/46 |
| 6,865,896 | B2 * | 3/2005 | Kaji et al. | 62/78 |
| 2004/0250565 | A1 * | 12/2004 | Lee et al. | 62/407 |
| 2005/0042247 | A1 | 2/2005 | Gomoll et al. | |
| 2005/0238631 | A1 | 10/2005 | Burwell | |

FOREIGN PATENT DOCUMENTS

| | | | |
|---|---|---|---|
| EP | 0 978 481 | A2 | 2/2000 |
| EP | 1 475 432 | A1 | 11/2004 |
| JP | 5-203336 | A | 8/1993 |
| JP | 10-132447 | A | 5/1998 |
| JP | 10-311666 | A | 11/1998 |
| JP | 11-211329 | A | 8/1999 |
| JP | 11-218376 | A | 8/1999 |
| JP | 2001-66046 | A | 3/2001 |
| JP | 2003-28560 | A | 1/2003 |
| JP | 2004-101051 | A | 4/2004 |
| JP | 2004-202102 | A | 7/2004 |
| JP | 2004-524859 | A | 8/2004 |
| JP | 2005-164195 | A | 6/2005 |
| JP | 2005-315571 | A | 11/2005 |
| KR | 10-2005-0087741 | A | 8/2005 |
| KR | 10-2007-0051586 | A | 5/2007 |
| KR | 10-2007-0051587 | A | 5/2007 |
| WO | WO 02/092790 | A1 | 11/2002 |
| WO | WO 03/071205 | A1 | 8/2003 |
| WO | WO 2004/088224 | A1 | 10/2004 |
| WO | WO 2007/058476 | A2 | 5/2007 |

* cited by examiner

[Fig. 1]
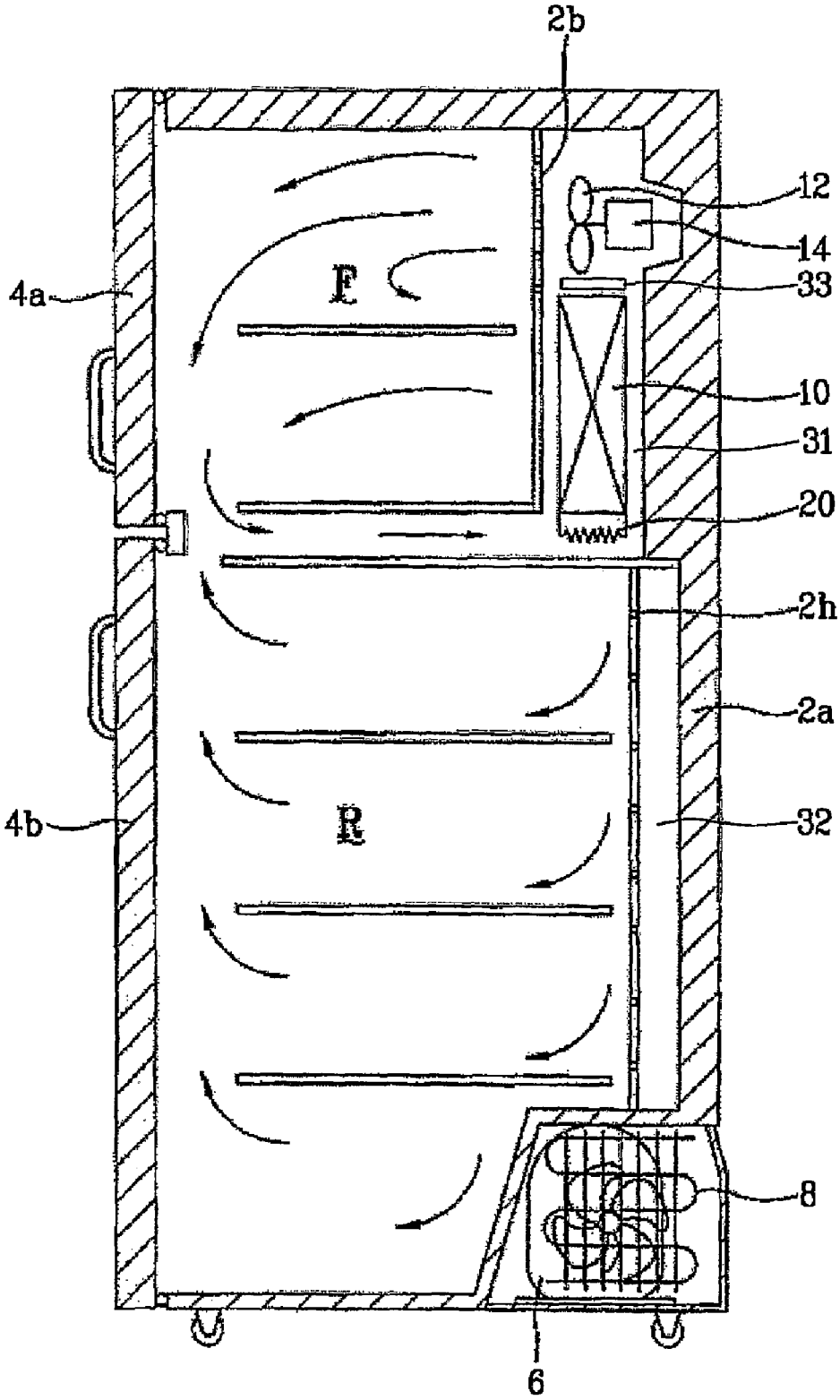

[Fig. 2]
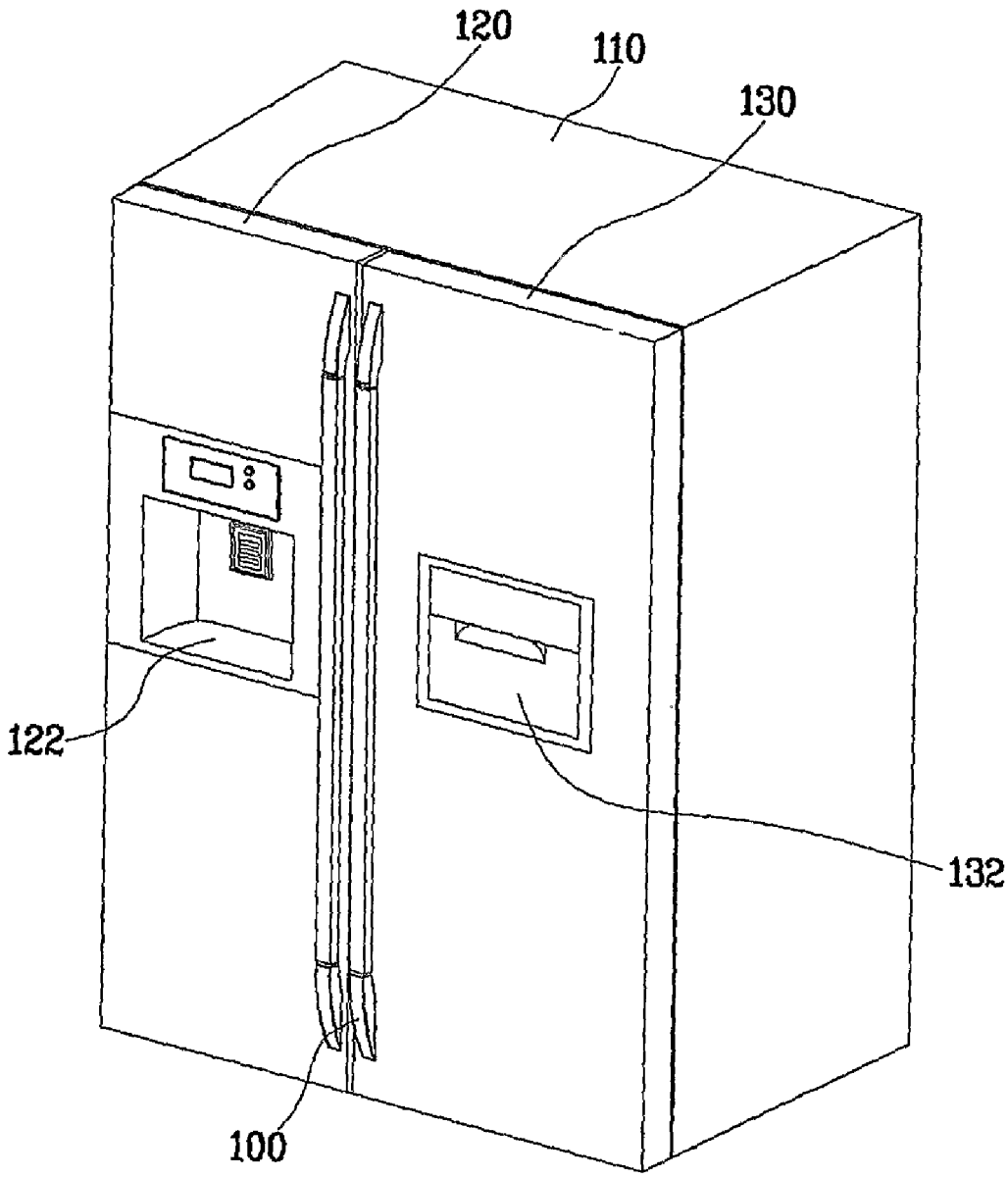

[Fig. 3]
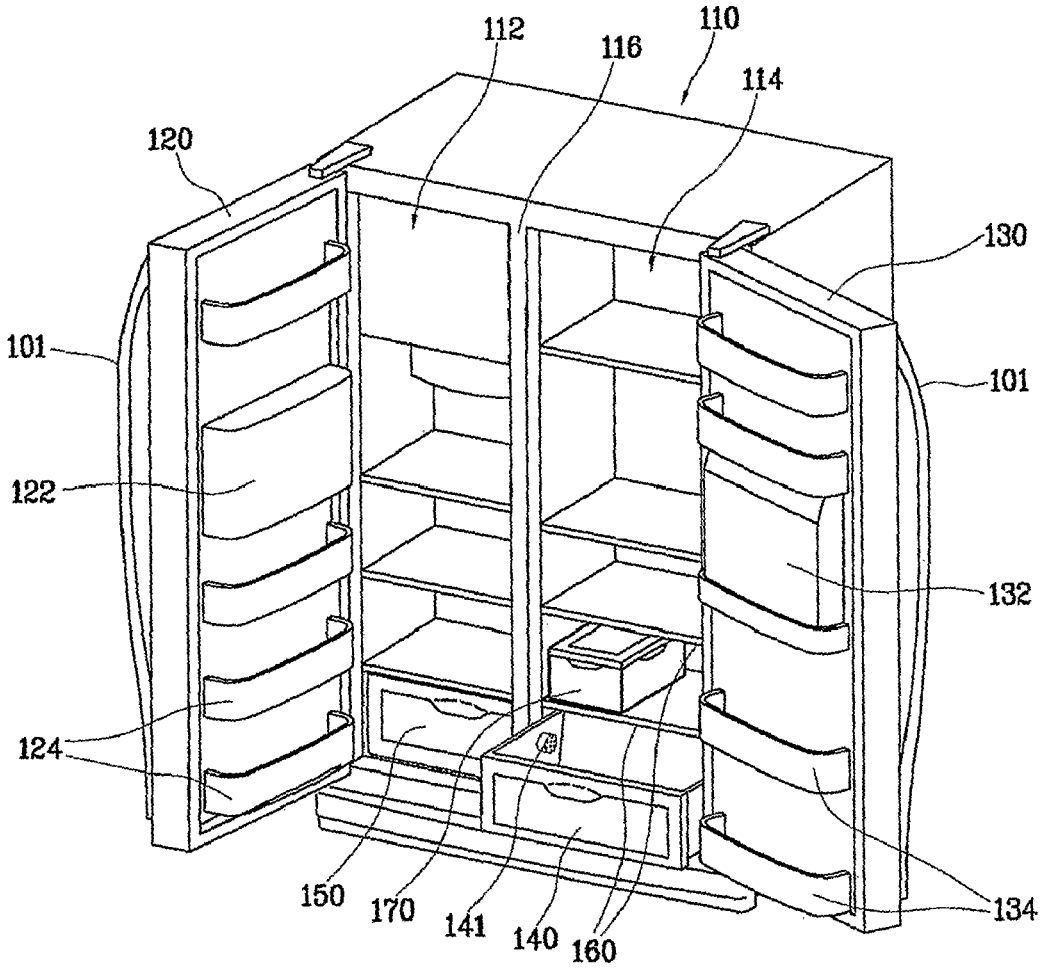
[Fig. 4]
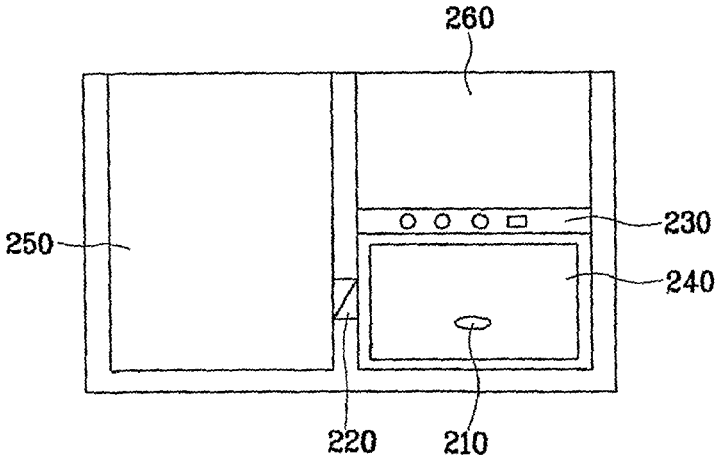

[Fig. 5]
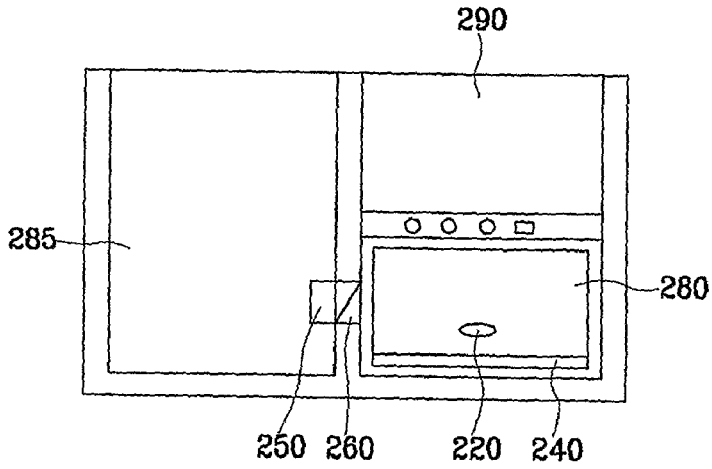
[Fig. 6]
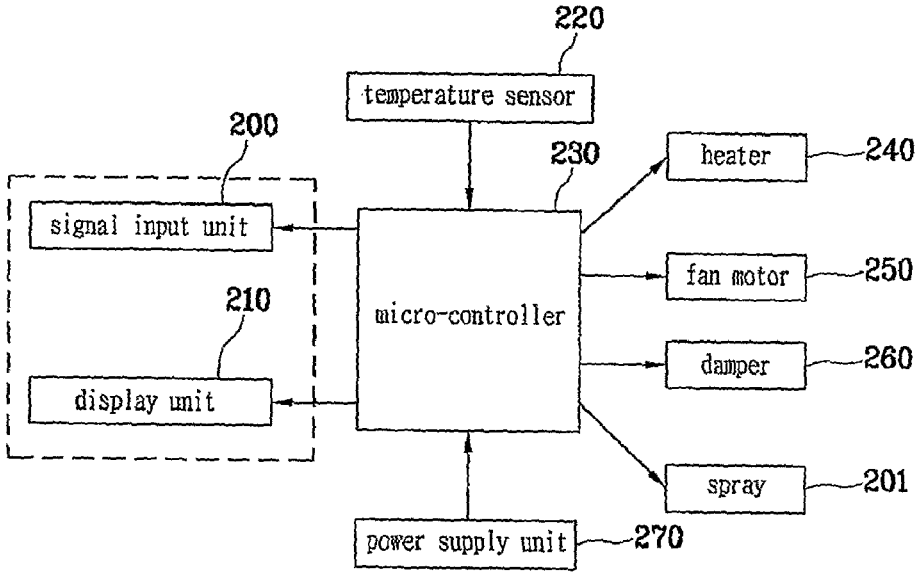
[Fig. 7]
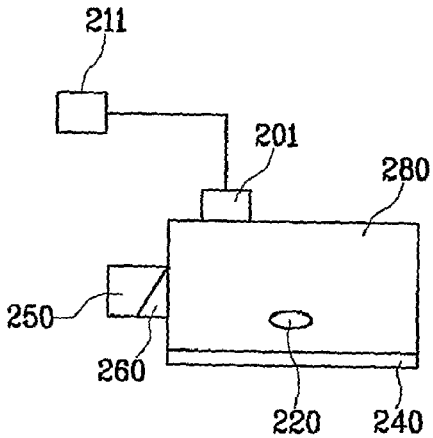

[Fig. 8]
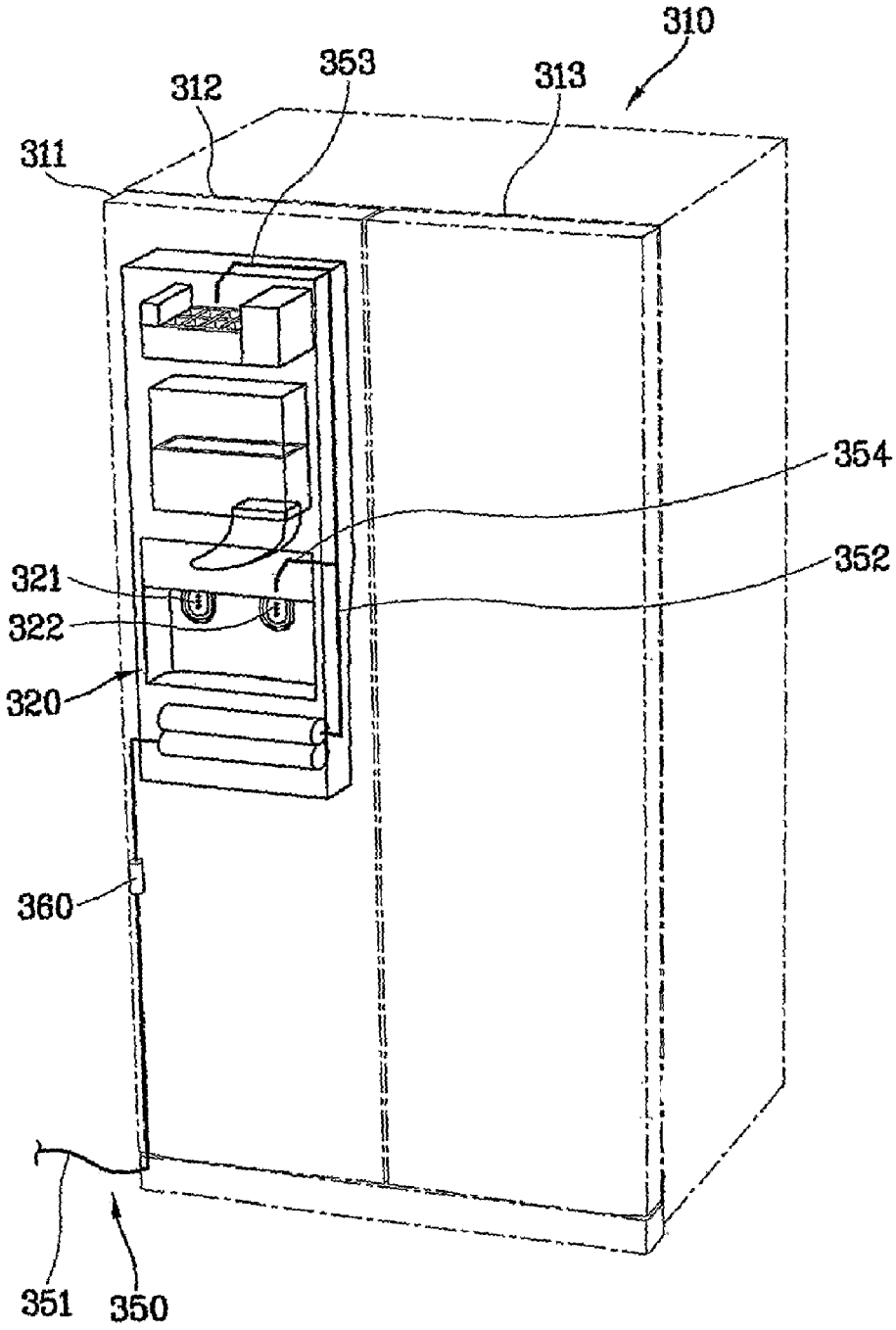

[Fig. 9]
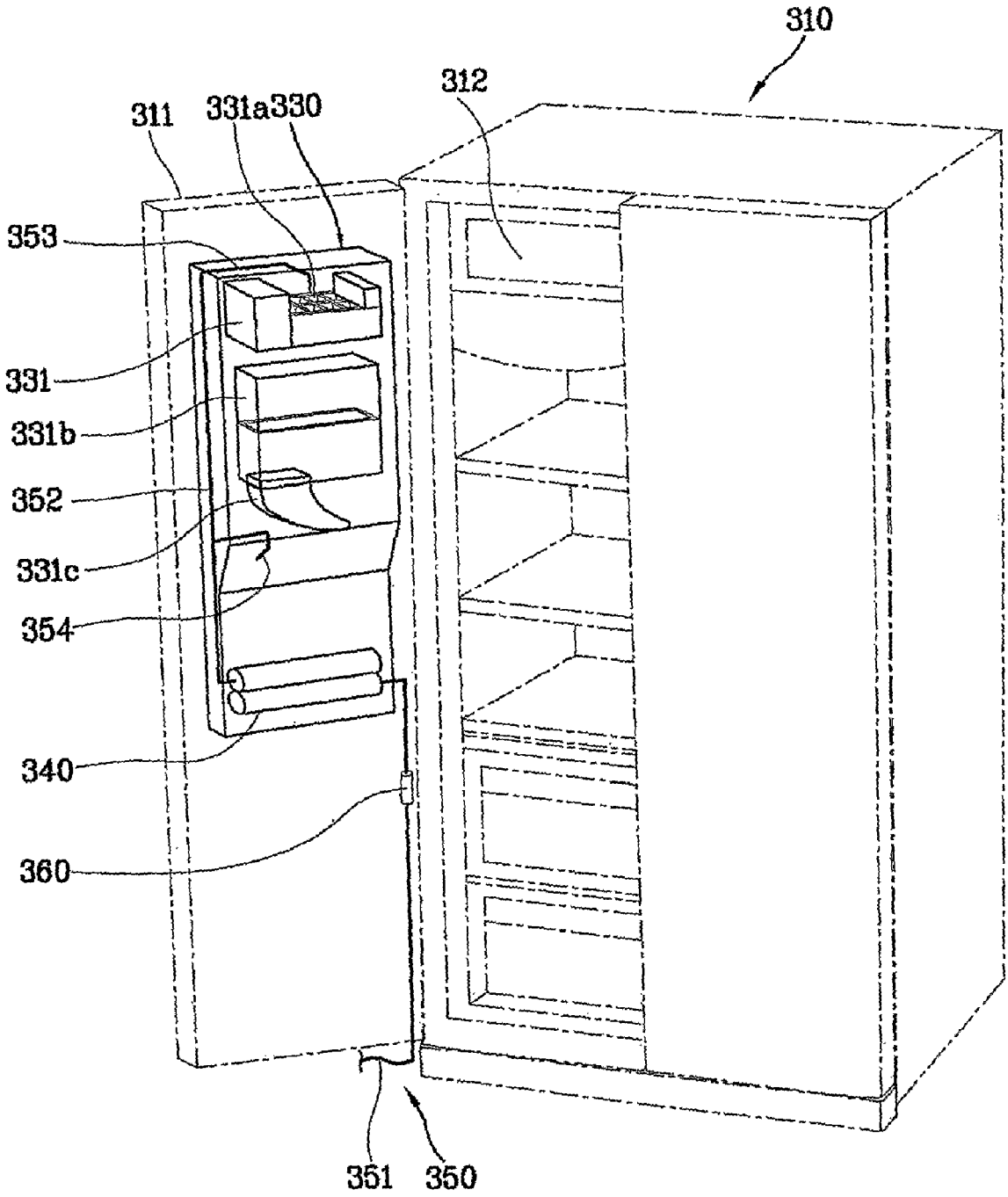

[Fig. 10]
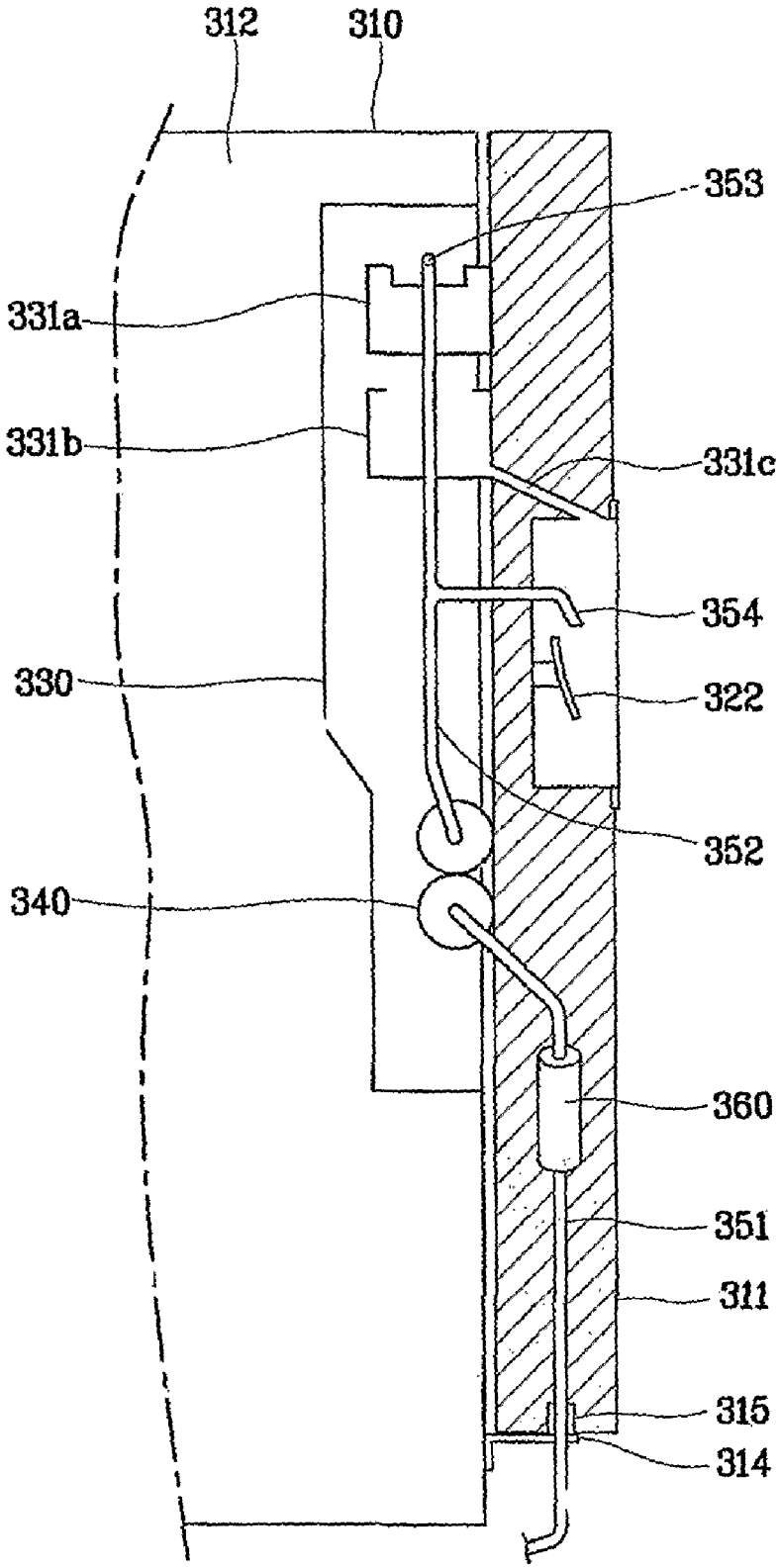

[Fig. 11]
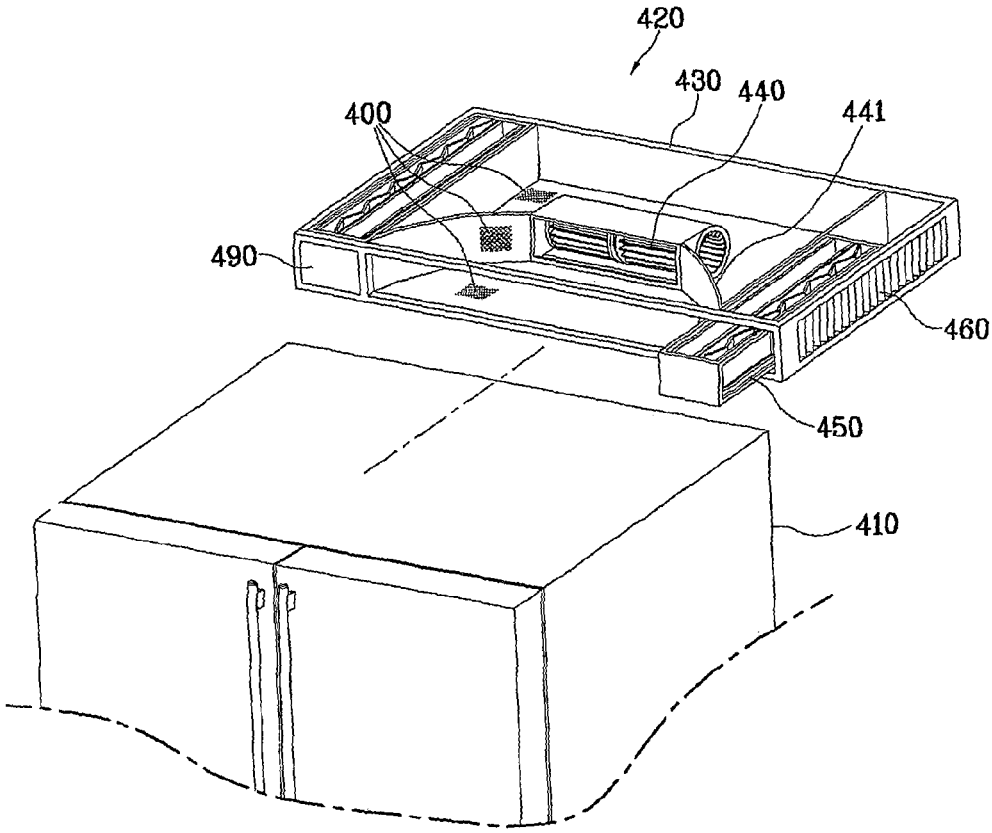
[Fig. 12]
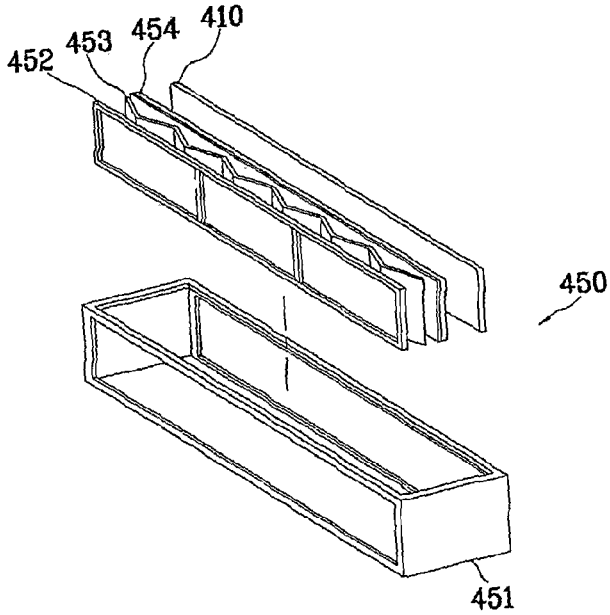

[Fig. 13]
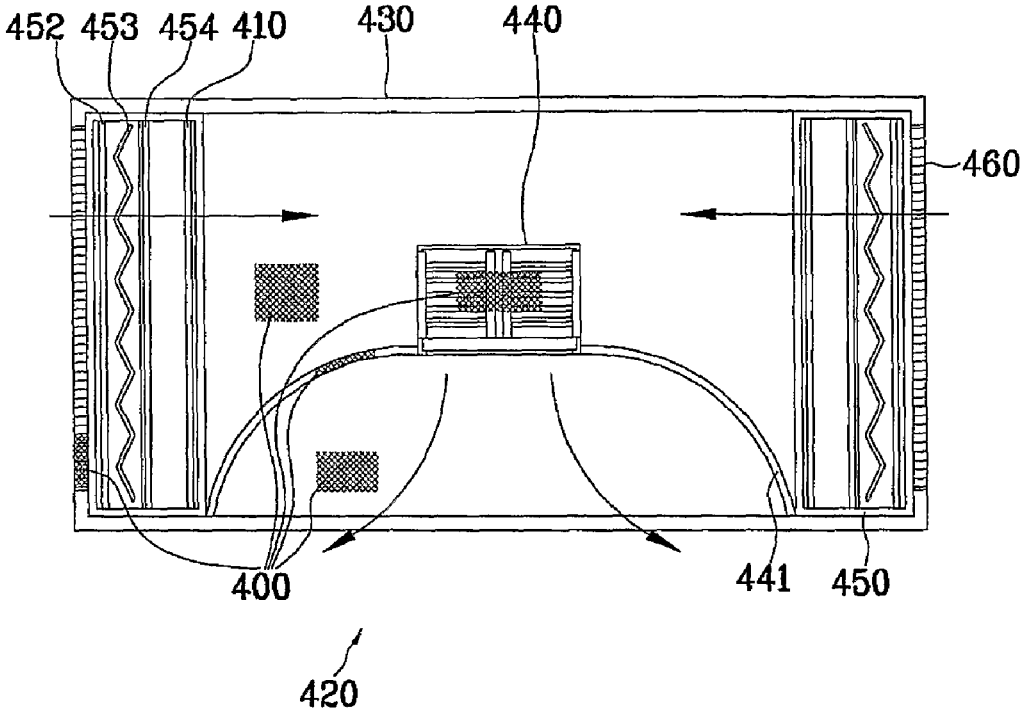

REFRIGERATOR

TECHNICAL FIELD

The present invention relates to a refrigerator, and more particularly, to a refrigerator which has undergone a Kimchi lactic acid bacteria culture treatment (coating of a Kimchi lactic acid bacteria culture, etc.) and/or a Kimchi lactic acid bacteria culture exposure treatment (installation of a filter containing a Kimchi lactic acid bacteria culture, etc.).

BACKGROUND ART

Recently, with a growing interest in the hygiene and cleanliness, a number of products have been developed to improve the hygiene and cleanliness. The electronic product field is not an exception. In detail, electric home appliances needing the hygiene and cleanliness include a refrigerator, washing machine, drying machine, air conditioner, air freshener or cleaner, fan, cleaner, electric pot, electric cooker, dishwashing machine, dish drying machine, microwave oven, mixer, VTR, television, home theater, etc.

Bacteria or molds which can be parasitic on the surfaces of the products or the surfaces of the components of the products cause diseases such as atopic dermatitis, respiratory trouble, etc., disfigure the products, generate a bad smelly external appearances of the products. It is therefore necessary to manufacture an antimicrobial article for protecting the users from the diseases and keeping the external appearances of the products, by preventing the contact and proliferation of various bacteria and molds.

Generally, most of antibacterial agents for manufacturing an antibacterial article are chemically synthesized, to require the high cost and cause harmful side effects. Recently, researches have been actively made on a natural antibacterial material which has an excellent antibacterial property and removes side effects harmful for a human body.

Kimchi lactic acid bacteria are generated in fermentation and ripening of Kimchi. Safety of the Kimchi lactic acid bacteria with the natural origin has been verified by the long time use. It is easy to acquire the Kimchi lactic acid bacteria at a low cost. In addition, the Kimchi lactic acid bacteria have been known as a natural antibacterial material with an excellent antibacterial property and a wide antibacterial spectrum. Moreover, there has been reported that the Kimchi lactic acid bacteria culture fluid could restrict avian influenza, and activity of viruses with the similar mechanism to that of avian influenza viruses.

Accordingly, the present inventors have accomplished this invention by giving the antimicrobial property to a surface of an article by using the antibacterial and antivirus effects of the Kimchi lactic acid bacteria culture fluid.

DISCLOSURE OF INVENTION

Technical Problem

An object of the present invention is to provide a refrigerator which has undergone a Kimchi lactic acid bacteria culture treatment and/or a Kimchi lactic acid bacteria culture exposure treatment with antibacterial and antivirus effects.

Another object of the present invention is to provide a refrigerator whose region exchanging heat with an evaporator has undergone a Kimchi lactic acid bacteria culture treatment and/or a Kimchi lactic acid bacteria culture exposure treatment.

Yet another object of the present invention is to provide a refrigerator whose, inner part or door has undergone a Kimchi lactic acid bacteria culture treatment and/or a Kimchi lactic acid bacteria culture exposure treatment.

Yet another object of the present invention is to provide a refrigerator whose variable temperature chamber has undergone a Kimchi lactic acid bacteria culture treatment and/or a Kimchi lactic acid bacteria culture exposure treatment.

Yet another object of the present invention is to provide a refrigerator whose evaporator, dispenser and/or ice maker have undergone a Kimchi lactic acid bacteria culture treatment and/or a Kimchi lactic acid bacteria culture exposure treatment.

Yet another object of the present invention is to provide a refrigerator whose air freshener has undergone a Kimchi lactic acid bacteria culture treatment and/or a Kimchi lactic acid bacteria culture exposure treatment.

Technical Solution

In an aspect of the present invention, there is provided a refrigerator, including: a refrigerating cycle having an evaporator; a space for exchanging heat with the evaporator; a region for exchanging heat between the evaporator and the space; and a storage chamber and a door for defining the space, wherein at least one of the region, the storage chamber and the door has undergone at least one of a Kimchi lactic acid bacteria culture treatment and a Kimchi lactic acid bacteria culture exposure treatment. For example, in the case of a direct cooling type refrigerator, the region means an evaporator, a storage chamber corresponding to the evaporator, and a space between the evaporator and the corresponded storage chamber, and in the case of an indirect cooling type refrigerator, the region means a region relating to a cool air passage provided with a fan, an evaporator, a cool air duct, and the like.

In another aspect of the present invention, the Kimchi lactic acid bacteria culture treatment is performed by at least one of coating of a Kimchi lactic acid bacteria culture and molding of a material containing a Kimchi lactic acid bacteria culture.

In another aspect of the present invention, the Kimchi lactic acid bacteria culture exposure treatment is performed by at least one of installation of a filter and supply of a Kimchi lactic acid bacteria culture.

In another aspect of the present invention, the region has undergone the Kimchi lactic acid bacteria culture treatment, and the region undergone by the Kimchi lactic acid bacteria culture treatment is the evaporator. For example, the Kimchi lactic acid bacteria culture treatment can be carried out on the surface or fins of the evaporator. In addition, the Kimchi lactic acid bacteria culture treatment can be carried out on a drain tube for removing condensed water from the surface of the evaporator.

In another aspect of the present invention, the refrigerator includes a passage extended to the region and used for heat exchange.

In another aspect of the present invention, the refrigerator includes a filter disposed on the passage. Therefore, the Kimchi lactic acid bacteria culture exposure treatment can be applied to the conventional refrigerator including the passage.

In another aspect of the present invention, the storage chamber is delimited by an inner casing, and includes at least one of a shelf, a basket, a food container and a drawer. Especially, moisture or water may exist in the food container and the drawer, to contaminate the food container and the drawer. This space can be provided with the antibacterial property by the Kimchi lactic acid bacteria culture treatment and/or the Kimchi lactic acid bacteria culture exposure treatment. Such treatments include supplying the Kimchi lactic acid bacteria culture to the space.

In another aspect of the present invention, the door includes a door handle. The refrigerator or the user of the refrigerator can be indirectly provided with the antibacterial property by treating the door handle with the Kimchi lactic acid bacteria culture.

In another aspect of the present invention, there is provided a refrigerator, including: a refrigerating cycle having an evaporator; a space for containing the cool air having a low temperature by exchanging heat with the evaporator; and at least one member which has undergone at least one of a Kimchi lactic acid bacteria culture treatment and a Kimchi lactic acid bacteria culture exposure treatment, the at least one member contacting water exchanging heat with the cool air of the space. Especially, at least one member can be an element composing a dispenser for supplying cool water. In addition, at least one member can be one or more elements composing an ice maker for making ice or discharging the ice through a door.

In another aspect of the present invention, there is provided a refrigerator, including: a refrigerating cycle having an evaporator; a space for exchanging heat with the evaporator; a region for exchanging heat between the evaporator and the space; and an air freshener which has undergone at least one of a Kimchi lactic acid bacteria culture treatment and a Kimchi lactic acid bacteria culture exposure treatment, the air freshener being disposed at one side of the space.

Advantageous Effects

In accordance with a refrigerator of the present invention, it is possible to improve an antimicrobial property on surfaces of various articles needing an antimicrobial effect, by using a Kimchi lactic acid bacteria culture with the wide antibacterial spectrum.

Also, in accordance with a refrigerator of the present invention, it is possible to give an antivirus effect against avian influenza, and viruses with the similar mechanism to that of avian influenza viruses, by using the excellent antivirus activity of a Kimchi lactic acid bacteria culture.

BRIEF DESCRIPTION OF THE DRAWINGS

FIG. 1 is a view illustrating one example of a refrigerator in accordance with the present invention;

FIG. 2 is a view illustrating another example of the refrigerator in accordance with the present invention;

FIG. 3 is a view illustrating a door open state of the refrigerator of FIG. 2;

FIG. 4 is a view illustrating one example of a refrigerator with a variable temperature chamber in accordance with the present invention;

FIG. 5 is a view illustrating another example of the refrigerator with the variable temperature chamber in accordance with the present invention;

FIG. 6 is a block diagram provided to explain a method of controlling a temperature of the variable temperature chamber in accordance with the present invention;

FIG. 7 is a view illustrating one example of the variable temperature chamber in accordance with the present invention;

FIG. 8 is a view illustrating yet another example of the refrigerator in accordance with the present invention;

FIG. 9 is a view illustrating a door open state of the refrigerator of FIG. 8;

FIG. 10 is a schematic view illustrating a dispenser in accordance with the present invention;

FIGS. 11 and 12 are views illustrating yet another example of the refrigerator in accordance with the present invention; and FIG. 13 is a view illustrating an air freshener of the refrigerator in accordance with the present invention.

MODE FOR THE INVENTION

The present invention will now be described in detail with reference to the accompanying drawings.

FIG. 1 is a view illustrating one example of the refrigerator in accordance with the present invention. A freezing chamber door 4*a* and a refrigerating chamber door 4*b* are installed on a front surface of a refrigerator main body 2*a* and 2*b* having a freezing chamber F and a refrigerating chamber R at its upper and lower sides to be opened and closed thereon. An evaporator 10 is installed in a space formed in an inner wall of the freezing chamber F. A refrigerating cycle connected to the evaporator 10 is installed at one side of the refrigerator main body 2*a* and 2*b*. A ventilation fan 12 and a motor 14 for sending the cool air to the freezing chamber F and the refrigerating chamber R are installed at the upper portion of the evaporator 10. Here, the refrigerator main body 2*a* and 2*b* includes an insulation (not shown) between an outer casing 2*a* and an inner casing 2*b*. A compressor 6, a condenser 8 and a capillary tube (not shown) connected to the evaporator 10 through a refrigerant tube are built in a mechanical chamber installed at the lower portion of the refrigerator main body 2*a* and 2*b*. The evaporator 10 is built in the inner casing 2*b* of the freezing chamber F. A drain tube (not shown) for guiding condensed water formed on the surface of the evaporator 10, and a drain fan (not shown) for collecting condensed water are installed at the lower portion of the condenser 8. Cool air circulation passages 31 and 32 are formed inside the inner casing 2*b* of the refrigerating chamber R, so that the cool air heat-exchanged with the evaporator 10 can be circulated in the refrigerating chamber R as well as the freezing chamber F. A plurality of cool air distribution holes 2*h* are formed on the inner casing 2*b* of the refrigerating chamber F. A filter 33 can be installed on the cool air circulation passages 31 and 32. On the other hand, a temperature sensor (not shown) and a defrosting heater 20 are installed at one side of the evaporator 10. If moisture of the air passing through the evaporator 10 is frosted on the surface of the evaporator 10, the temperature sensor senses frosting, and the defrosting sensor 20 performs the defrosting operation. The components such as the compressor 6 and the motor 14 are connected to and controlled by a control unit (not shown). Accordingly, when the control unit operates the compressor 6 and the motor 14, as the compressor 6 is operated, refrigerants are circulated along the compressor 6, the condenser 8, the capillary tube and the evaporator 10, exchange heat with the ambient air of the evaporator 10 and generate the cool air, and as the ventilation fan 12 is rotated, the cool air is sent to the freezing chamber F and the refrigerating chamber R, for performing freezing and refrigeration.

The aforementioned refrigerator is a top mount type refrigerator having a freezing chamber oh a refrigerating chamber. However, cool air circulation passages equivalent to the cool air circulation passages 31 and 32 are also formed in a French door type refrigerator having a freezing chamber and a refrigerating chamber at both sides. Although an evaporator of a Kimchi refrigerator does not directly exchange heat with the indoor air of the Kimchi refrigerator, the principle of the present invention can be applied to the Kimchi refrigerator as it is.

The first aspect of the present invention (FIG. 1) performs at least one of the Kimchi lactic acid bacteria, culture treatment and the Kimchi lactic acid bacteria culture exposure treatment on the evaporator 10. For example, the evaporator 10 (surface of the evaporator or surfaces of fins of the evaporator) can be coated with the Kimchi lactic acid bacteria culture and provided with the antibacterial property (detailed coating method will later be explained). The Kimchi lactic acid bacteria culture coated on the evaporator 10 removes bacteria latent on the foods stored in the refrigerator, or the frost accumulated on the evaporator 10 by the moisture of the cool air sucked into the refrigerator with the outdoor air and circulated inside the refrigerator. Even through the temperature of the evaporator 10 is raised by the operation of the defrosting heater 20, the bacteria are not propagated but extinguished in the evaporator region. As a result, the number of the bacteria existing in the cool air heat-exchanged with the evaporator 10 and applied to the freezing chamber F or the refrigerating chamber R can be reduced. Identically to the evaporator 10, the drain tube for guiding the condensed water formed on the surface of the evaporator 10 and the drain fan for collecting the condensed water can be coated with the Kimchi lactic acid bacteria culture and provided with the antibacterial property. In the case that the drain tube and the drain fan are manufactured by injection molding, the drain tube and the drain fan can be molded by using the Kimchi lactic acid bacteria culture or the encapsulated Kimchi lactic acid bacteria culture according to a molding method discussed later.

The second aspect of the present invention (FIG. 1) performs at least one of the Kimchi lactic acid bacteria culture treatment and the Kimchi lactic acid bacteria culture exposure treatment on the cool air circulation passages 31 and 32. For example, the surface of the ventilation fan 12 for forcibly circulating the cool air on the cool air circulation passages 31 and 32 can be coated with the Kimchi lactic acid bacteria culture, or the ventilation fan 12 itself can be molded by using the Kimchi lactic acid bacteria culture or the encapsulated Kimchi lactic acid bacteria culture (detailed coating and molding methods will later be explained). When the surface of the ventilation fan 12 is coated with the Kimchi lactic acid bacteria culture, or the ventilation fan 12 itself is molded by using the Kimchi lactic acid bacteria culture or the encapsulated Kimchi lactic acid bacteria culture, bacteria existing in the foods stored in the refrigerator or the cool air sucked into the refrigerator with the outdoor air and circulated inside the refrigerator are extinguished in contact with the ventilation fan 12. In addition, the Kimchi lactic acid bacteria culture can be contained in a material of the antibacterial and deodorization filter 33 (detailed manufacturing method of the filter will later be described). Therefore, bacteria existing in the foods stored in the refrigerator or the cool air sucked into the refrigerator with the outdoor air and circulated inside the refrigerator are extinguished or filtered of by the filter 33 (bacteria can be filtered off by another filter and extinguished in contact with the Kimchi lactic acid bacteria culture). Accordingly, the number of the bacteria existing in the cool air applied to the freezing chamber R or the refrigerating chamber F can be reduced. Moreover, since the bacteria do not propagate themselves, the deodorization performance can be improved. In the case that the filter 33 is installed in front of or behind the ventilation fan 12, the antibacterial effect and the deodorization effect can be more improved against the bacteria mixed with the cool air forcibly sent by the ventilation fan 12. On the other hand, the inner and outer surfaces of the ducts forming the cool air circulation passages 31 and 32 can be coated with the Kimchi lactic acid bacteria culture, or the ducts can be molded by using the Kimchi lactic acid bacteria culture or the encapsulated Kimchi lactic acid bacteria culture (detailed coating and molding methods will later be explained). When the surfaces of the ducts are coated with the Kimchi lactic acid bacteria culture, or the ducts are molded by using the Kimchi lactic acid bacteria culture or the encapsulated Kimchi lactic acid bacteria culture, bacteria existing in the foods stored in the refrigerator or the cool air sucked into the refrigerator with the outdoor air and circulated inside the refrigerator are extinguished in contact with the ducts of the cool air circulation passages 31 and 32. As a result, the number of the bacteria existing in the cool air applied to the freezing chamber R or the refrigerating chamber F can be reduced.

FIG. 2 is a view illustrating another example of the refrigerator in accordance with the present invention. The refrigerator 110 is a French door type refrigerator. A freezing chamber door 120 and a refrigerating chamber door 130 are formed at both sides of the refrigerator 110. A dispenser unit 122 is installed on the freezing chamber door 120, so that the user can use cold water or ice from an ice maker. A home bar door 132 is installed on the refrigerating chamber door 130, so that the user can easily take out beverages stored in the refrigerator 110 without opening the refrigerating chamber door 130. The doors 120 and 130 can be opened and closed by using door handles 101.

FIG. 3 is a view illustrating a door open state of the refrigerator of FIG. 2. When the freezing chamber door 120 and the refrigerating chamber door 130 are opened, the internal space of the refrigerator 110 is partitioned off into a freezing chamber space 112 and a refrigerating chamber space 114 by a partition wall 116. A plurality of shelves 160 are installed in the freezing chamber space 112 and the refrigerating chamber space 114, for efficiently keeping foods. The outer block of the freezing chamber space 112 and the refrigerating chamber space 114 is called an inner casing. A plurality of freezing chamber baskets 124 are installed inside the freezing chamber door 120, and a plurality of refrigerating chamber baskets 134 are installed inside the refrigerating chamber door 130, so that foods can be kept in each basket 124 and 134. A special freezing chamber drawer 150 for containing the foods that need to be kept in a different temperature range from the temperature range of the freezing chamber space 112 is installed at the lower portion of the freezing chamber 112. In addition, a special refrigerating chamber drawer 140 for containing the foods that need to be kept in a different temperature range from the temperature range of the refrigerating chamber space 114 is installed at the lower portion of the refrigerating chamber 114. If necessary, hot wires (not shown) or duct means for supplying the cool air directly from the freezing chamber 112 or the refrigerating chamber 114 can be provided to the outer blocks of the spaces for taking out the drawers 140 and 150. A Kimchi lactic acid bacteria culture kit 141 can be installed on at least one of the drawers 140 and 150 like a vitamin kit for a vegetable storage drawer. In this case, as discussed later, the antibacterial effect is obtained inside the drawers 140 and 150 by the Kimchi lactic acid bacteria culture kit 141. A food container 170 for containing foods is put on the shelf 160. In a state where the food container 173 contains the foods, it can be kept in the refrigerator 110. As the representative food container 170, a Kimchi container containing Kimchi is put on the shelf 160 of the refrigerator 110 and refrigerated in the refrigerator 110. In this embodiment, the French door type refrigerator has been exemplified. It must be recognized that the concept of the present invention can be equally applied to the top mount type refrigerator, the French door type refrigerator and the Kimchi refrigerator. Although the Kimchi refrigerator does not include the shelves or baskets, it needs the inner casing and the food container.

One of the most remarkable characteristics of the present invention (FIG. 2) coats the surfaces of the inner casing (including the shelves and the baskets), the food container and the drawer with the Kimchi lactic acid bacteria culture, or molds the aforementioned members by using the Kimchi lactic acid bacteria culture or the encapsulated Kimchi lactic acid bacteria culture (detailed coating and molding methods will later be described). When the surfaces of the members are coated with the Kimchi lactic acid bacteria culture, or the members are molded by using the Kimchi lactic acid bacteria culture or the encapsulated Kimchi lactic acid bacteria culture, bacteria existing in the foods stored in the refrigerator or originating from the outdoor air are extinguished in contact with such members. As a result, the number of the bacteria left in the refrigerator can be reduced.

Another one of the most remarkable characteristics of the present invention (FIG. 2) coats the inner and outer walls of the doors and the surfaces of the door handles with the Kimchi lactic acid bacteria culture, or molds the aforementioned members by using the Kimchi lactic acid bacteria culture or the encapsulated Kimchi lactic acid bacteria culture (detailed coating and molding methods will later be described). When the surfaces of the members are coated with the Kimchi lactic acid bacteria culture, or the members are molded by using the Kimchi lactic acid bacteria culture or the encapsulated Kimchi lactic acid bacteria culture, bacteria do not propagate themselves on the members.

FIG. 4 is a view illustrating one example of a refrigerator with a variable temperature chamber in accordance with the present invention. The refrigerator includes a freezing chamber 250 and a refrigerating chamber 260. Although not illustrated, a cooling cycle is formed on the rear surface of the freezing chamber 250, for compressing, condensing and heat-exchanging refrigerants to supply the cool air into the refrigerator. A variable temperature chamber 240 is disposed at the bottom end of the refrigerating chamber 260. The cool air supplied to the variable temperature chamber 240 is controlled by opening and closing a damper 220 connected to the freezing chamber 250. The variable temperature chamber 240 is controlled on the basis of a value sensed by a built-in variable temperature chamber temperature sensor 210. That is, when the value sensed by the variable temperature chamber temperature sensor 210 mounted in the variable temperature chamber 240 is transmitted to a micro-controller (not shown), the micro-controller decides whether the temperature inside the variable temperature chamber 240 is appropriate according to the sensed value. If the micro-controller decides that the temperature inside the variable temperature chamber 240 is appropriate, the micro-controller closes the variable temperature chamber damper 220, so that the cool air cannot be transferred from the freezing chamber 250 to the variable temperature chamber 240. Accordingly, the cool air flow supplied from the freezing chamber 250 to the variable temperature chamber 240 is completely intercepted. On the other hand, if the micro-controller decides that the temperature inside the variable temperature chamber 240 is not appropriate, the micro-controller opens the variable temperature chamber damper 220, so that the cool air can be transferred from the freezing chamber 250 to the variable temperature chamber 240. As a result, the cool air is supplied from the freezing chamber 250 to the variable temperature chamber 240, thereby lowering the temperature inside the variable temperature chamber 240.

FIG. 5 is a view illustrating another example of the refrigerator with the variable temperature chamber in accordance with the present invention. The refrigerator includes a freezing chamber 285, a refrigerating chamber 290, and a variable temperature chamber 280 disposed at the bottom end of the refrigerating chamber 290. Here, the freezing chamber 285 has the lowest temperature, the variable temperature chamber 280 has the intermediate temperature, and the refrigerating chamber 290 has the highest temperature. On the other hand, when the variable temperature chamber 280 performs thawing, the variable temperature chamber 280 has a higher temperature than the refrigerating chamber 290. The temperatures inside each chamber are controlled on the basis of values sensed by temperature sensors mounted in each chamber. The variable temperature chamber 280 is disposed at the bottom end of the refrigerating chamber 290. The cool air supplied to the variable temperature chamber 280 is controlled by opening and closing a variable temperature chamber damper 260 connected between the freezing chamber 285 and the variable temperature chamber 280. When the damper 260 is opened, a freezing chamber fan motor 250 is driven to smoothly supply the cool air. The internal state of the variable temperature chamber 280 is sensed by a temperature sensor 220 disposed at the variable temperature chamber 280. To raise the temperature inside the variable temperature chamber 280 in a short time, a variable temperature chamber heater 240 for generating heat is mounted on the bottom end of the variable temperature chamber 280.

FIG. 6 is a block diagram provided to explain a method of controlling the temperature of the variable temperature chamber in accordance with the present invention. Shown are a power supply unit 270 for supplying power to a refrigerator, a signal input unit 200 for inputting an operation signal (temperature, operation state, etc.) to the refrigerator, a display unit 210 for displaying the inputted operation signal, a variable temperature chamber heater 240 mounted in the variable temperature chamber 280, for generating heat, a variable temperature chamber temperature sensor 220 mounted in the variable temperature chamber 280, for sensing the temperature inside the variable temperature chamber 280, a variable temperature chamber damper 260 mounted between the variable temperature chamber 280 and the freezing chamber, for controlling the cool air flow supplied to the variable temperature chamber 280, a variable temperature chamber fan motor 250 for efficiently sending the cool air to the variable temperature chamber 280, and a micro-controller 230 for maintaining an appropriate temperature inside the refrigerator, and controlling a temperature inside the variable temperature chamber 280 by setting of the user. The signal input unit 200 includes function keys for selecting thawing and rapid cooling of the variable temperature chamber 280 as well as the general operations of the refrigerator. The display unit 210 includes a plurality of lamps so that the user can easily check the state of the refrigerator. The corresponding lamp is turned on to indicate, for example, rapid freezing or defrosting. The variable temperature chamber temperature sensor 220 is mounted at one side of the variable temperature chamber 280. The variable temperature chamber temperature sensor 220 transmits the sensed temperature of the variable temperature chamber 280 to the micro-controller 230. The variable temperature chamber heater 240 is driven in thawing on the basis of the temperature sensed by the variable temperature chamber temperature sensor 220. When the thawing starts, the variable temperature chamber heater 240 is turned on until the temperature inside the variable temperature chamber 280 reaches a predetermined temperature for a predetermined time. When the temperature inside the variable temperature chamber 280 reaches the predetermined temperature, the variable temperature chamber heater 240 is turned off. A driving time and a driving temperature of the variable temperature chamber heater 240 for thawing are based on experiment values acquired in an experiment. On the other hand, the micro-controller 230 recognizes the temperature from the variable temperature chamber temperature sensor 220, and checks the current temperature inside the variable temperature chamber 280. If the micro-controller 230 decides that the temperature inside the variable temperature chamber 280 is appropriate, the micro-controller 230 stops driving of the variable temperature chamber damper 260 and the variable temperature chamber fan motor 250 to intercept the cool air flow from the freezing chamber to the variable temperature chamber 280. However, if the micro-controller 230 decides that the temperature inside the variable temperature chamber 280 is not appropriate, the micro-controller 230 opens the variable temperature chamber damper 260 and drives the variable temperature chamber fan motor 250 to supply the cool air from the freezing chamber to the variable temperature chamber 280. As a result, the cool air is rapidly supplied to the variable temperature chamber 280, thereby lowering the temperature inside the variable temperature chamber 280. That is, in keeping the foods in the variable temperature chamber 280, the micro-controller 230 maintains a low temperature inside the variable temperature chamber 280. In addition, in thawing the foods kept in the variable temperature chamber 280, the micro-controller 230 controls driving of the variable temperature chamber heater 240 mounted in the variable temperature chamber 280. The heat is supplied to the variable temperature chamber 280, for raising the temperature inside the variable temperature chamber 280. Accordingly, the kept foods are thawed. In accordance with the present invention, the use or the keeping temperature of the variable temperature chamber 280 are preset through the signal input unit 200, and driving of the damper 260, the fan motor 250 and the heater 240 of the variable temperature chamber 280 is controlled to maintain the preset temperature inside the variable temperature chamber 280. That is, if the inside temperature satisfies the preset keeping temperature, the damper 260 is closed and the fan motor 250 is stopped not to supply the cool air to the variable temperature chamber 280. If the inside temperature does not satisfy the preset keeping temperature, the damper 260 is opened and the fan motor 250 is driven to supply the cool air until the inside temperature reaches the preset keeping temperature. When the thawing function is selected, the variable temperature chamber heater 240 is driven for a predetermined time or until the inside temperature reaches a predetermined temperature.

FIG. 7 is a view illustrating one example of the variable temperature chamber in accordance with the present invention. The variable temperature chamber 280 includes the temperature sensor 220, the heater 240, the fan motor 250 and the damper 260, and further includes a spray 201 connected to a container 211 for containing the Kimchi lactic acid bacteria culture, for spraying the powder phase or liquid phase Kimchi lactic acid bacteria culture into the variable temperature chamber 280. As shown in FIG. 6, the spray 201 is also controlled by the micro-controller 230. Preferably, in a specific time point after raising the temperature inside the variable temperature chamber 280 by the heater 240 (at a specific temperature sensed by the temperature sensor 220), the spray 201 sprays the Kimchi lactic acid bacteria culture of the container 211 into the variable temperature chamber 280 under the control of the micro-controller 230. The variable temperature chamber 280 includes the heater 240 for performing thawing or heat insulation. During the thawing or heat insulation, dampness or moisture is generated by the foods kept in the variable temperature chamber 280. Such dampness or moisture may contaminate the variable temperature chamber 280 which must be maintained clean. In accordance with the present invention, the Kimchi lactic acid bacteria culture is sprayed into the variable temperature chamber 280 after the thawing or heat insulation. Therefore, the variable temperature chamber 280 is provided with the antibacterial property and protected from contamination. In order to be continuously protected from contamination, the variable temperature chamber 280 can be treated with the Kimchi lactic acid bacteria culture, namely, coated with the Kimchi lactic acid bacteria culture or molded with a material containing the Kimchi lactic acid bacteria culture.

FIG. 8 is a view illustrating yet another example of the refrigerator in accordance with the present invention, FIG. 9 is a view illustrating a door open state of the refrigerator of FIG. 8, and FIG. 10 is a schematic view illustrating a dispenser in accordance with the present invention. The refrigerator 310 includes a door 311 of a freezing chamber 312, and a dispenser 320. The door 311 is formed in a plate shape to cover the opened surface of the freezing chamber 312 of the refrigerator 310 and isolate the freezing chamber 312 from the external space. The door 311 is rotatably coupled to one side end of the freezing chamber 312 through medium of hinges 314. In addition, the door 311 is a general refrigerator door filled with an insulation to prevent heat exchange between the cool air inside the refrigerator 310 and the outdoor air. The inner surface of the door 311 on which the dispenser 320 is installed is one surface of the door 311 facing the freezing chamber 312 and a refrigerating chamber 313 of the refrigerator 310. The dispenser 320 discharges ice and cold water through an ice discharge unit 321 and a cool air unit 322 outwardly exposed on the door 311. The dispenser 320 includes a water tank 340, an ice maker 331, the ice discharge unit 321, the cool air unit 322, and a water supply tube 350. The water tank 340 is formed by fastening two hollow cylinders on the inner surface of the door 311 of the freezing chamber 312 to communicate with each other. Here, the water tank 340 has its one surface fixed to the inner surface of the door 311. When the door 311 is closed, the water tank 340 is partially inserted into the freezing chamber 312. Instead of installing the water tank 340, water can be supplied from an external water supply source to a water filter and discharged through the dispenser 320. The ice maker 331 is installed at the upper portion of the inner surface of the door 311 above the water tank 340. The ice maker 331 includes an ice making tray 331*a* for storing water supplied to the inner surface of the door 311 above the water tank 340 for a predetermined time, receiving the cool air from the freezing chamber 312, and making ice from the stored water, an ice storing vessel 331*b* installed at the lower portion of the ice making tray 331*a*, for keeping the ice made in the ice making tray 331*a*, and an ice discharge guide 331*c* for forming a passage of externally discharging the ice stored in the ice storing vessel 331*b* by clicking of the ice discharge unit 321.

One of the most remarkable characteristics of the present invention (FIG. 8) coats the surface of the ice maker 331, for example, the surfaces of the ice making tray 331*a*, the ice storing vessel 331*b* and the ice discharge guide 331*c* with the Kimchi lactic acid bacteria culture, or molds the aforementioned members by using the Kimchi lactic acid bacteria culture or the encapsulated Kimchi lactic acid bacteria culture (detailed coating and molding methods will later be described). When the surfaces of the members are coated with the Kimchi lactic acid bacteria culture, or the members are molded by using the Kimchi lactic acid bacteria culture or the encapsulated Kimchi lactic acid bacteria culture, bacteria existing in the water supplied from the external water supply source or the foods stored in the refrigerator, or entering the ice maker 331 with the outdoor air are extinguished in contact with such members. As a result, the number of the bacteria left in the ice supplied from the ice maker 331 can be reduced.

Another one of the most remarkable characteristics of the present invention (FIG. 8) coats the inner surface of the water tank 340 with the Kimchi lactic acid bacteria culture, or molds the water tank 340 itself by using the Kimchi lactic acid bacteria culture or the encapsulated Kimchi lactic acid bacteria culture (detailed coating and molding methods will later be described). When the inner surface of the water tank 340 is coated with the Kimchi lactic acid bacteria culture, or the water tank 340 itself is molded by using the Kimchi lactic acid bacteria culture or the encapsulated Kimchi lactic acid bacteria culture, bacteria entering the water tank 340 with the water supplied from the external water supply source are extinguished in contact with the water tank 340. Accordingly, the number of the bacteria existing in the cool water discharged from the dispenser 320 or the ice supplied from the ice maker 331 can be reduced. The water supply tube 350 includes an inflow tube 351, a distribution tube 352, a first outflow tube 353 and a second outflow tube 354. The inflow tube 351 is a general water flow tube having its one end connected to the external water supply source of the refrigerator 310, and its other end inserted into the door 311 of the freezing chamber 312 through the bottom end of the door 311. In addition, the inflow tube 351 is inserted into the door 311 of the freezing chamber 312 through the lower hinge 314 of the door 311. The inflow tube 351 inserted into the door 311 communicates with one end of the water tank 340 installed on the inner surface of the door 311. Here, the inflow tube 351 is inserted into a hollow unit formed in the axial direction at a center of a hinge shaft 315 of the hinge 314 fastened to one side bottom end of the refrigerator 310, and thus inserted into the inner portion of the door 311 into which the hinge shaft 315 has been inserted. Also, the inflow tube 351 can be directly inserted through the bottom hinge 314 of the door 311 from the external water supply source, or can be inserted through the rear surface of the refrigerator 310, arranged at the lower portion of the freezing chamber 312, and inserted into the door 311 through the hinge 314 connected to the bottom ends of the freezing chamber 312 and the door 311 on the front surface of the freezing chamber 312. The inflow tube 351 inserted into the door 311 is extended toward the water tank 340 inside the door 311, protruded through the inner surface of the door 311 in which the water tank 340 has been installed, and connected to one end of the water tank 340. The distribution tube 352 is formed in a similar shape to that of the inflow tube 351 on the other surface of the water tank 340 having its one surface communicate with the inflow tube 351, inserted into the door 311, and extended toward the ice maker 331 and the cool air unit 322. Here, since the ice maker 331 and the cool air unit 322 are installed at the upper portion of the water tank 340, the distribution tube 352 is curvedly extended in the upward direction of the door 311 from the other surface of the water tank 340. The front end of the distribution tube 352 is extended to the top end of the ice maker 331. The first outflow tube 353 is formed in a similar shape to that of the inflow tube 351, and extended from the front end of the distribution tube 352 extended to the top end of the ice maker 331 to the top center of the ice maker 331. The second outflow tube 354 is formed in a similar shape to that of the inflow tube 351, and branched toward the cool water unit 322 from the distribution tube 352 disposed at the intermediate portion between the water tank 340 and the ice maker 331 in which the cool water unit 322 has been installed. Preferably, the water tank 340, the ice maker 331, the distribution tube 352, the first outflow tube 353 and the second outflow tube 354 are fastened to the inner surface and inside of the door 311 of the freezing chamber 312, and all housed in a housing 330. The housing 330 is formed in a box shape with its one surface opened, for covering all the components of the dispenser 320 such as the ice maker 331 and the water tank 340, and improving the internal appearance of the door 311. The inflow tube 351 is installed inside the door 311, but the distribution tube 352, the first outflow tube 353 and the second outflow tube 354 are connected to the water tank 340, the ice maker 331 and the cool water unit 322 inside the housing 330 of the door 311, respectively.

Yet another one of the most remarkable characteristics of the present invention (FIG. 8) coats the inner surfaces of the water supply tubes with the Kimchi lactic acid bacteria culture, or molds the water supply tubes by using the Kimchi lactic acid bacteria culture or the encapsulated Kimchi lactic acid bacteria culture (detailed coating and molding methods will later be described). When the inner surfaces of the water supply tubes are coated with the Kimchi lactic acid bacteria culture, or the water supply tubes/are molded by using the Kimchi lactic acid bacteria culture or the encapsulated Kimchi lactic, acid bacteria culture, bacteria existing in the water supplied from the external water supply source, the foods stored in the refrigerator, or the water supplied through the water supply tubes with the outdoor air are extinguished in contact with the water supply tubes. A filter 360 treated with the Kimchi lactic acid bacteria culture can be installed on at least one of the water supply tubes. Preferably, the filter 360 is installed at a predetermined portion of the inflow tube 351 connected to the water tank 340. The filter 360 can also be installed on the water supply tube which has passed through the water tank 340. The filter 360 can be installed in a multiple number.

FIGS. 11 and 12 are views illustrating yet another example of the refrigerator in accordance with the present invention, and FIG. 13 is a view illustrating an air freshener of the refrigerator in accordance with the present invention. The air freshener 420 of the refrigerator 410 for sucking the indoor air, freshening the sucked air and discharging the freshened air can be coated with the Kimchi lactic acid bacteria culture 400. In addition, Kimchi lactic acid bacteria culture filters can be built in purifiers 450 installed in the air freshener 420, for purifying the indoor air. In this embodiment, the air freshener 420 is installed on the top surface of the refrigerator 10. However, the air freshener 420 can be installed on the bottom surface or center of the refrigerator 410. The air freshener 420 includes a housing 430, a ventilator 440, passage partition walls 441, purifiers 450, suction grills 460 and a discharge grill 470. The housing 430 is formed in a box shape with a section equivalent to the top surface of the refrigerator 410, so that the housing 430 can be stably disposed on the top surface of the refrigerator 410. The ventilator 440 and the purifiers 450 are installed in the hollow space of the housing 430. The Kimchi lactic acid bacteria culture 400 for sterilizing the air flowing into the housing 430 is coated on the inner surface of the housing 430, or injected in injection molding of the housing 430 to be contained in the housing 430. The ventilator 440 is installed at the center of the housing 430, for sucking the air from both sides and discharging the air to the forward direction. In the ventilator 440, a plurality of blades are rotated to pressurize and send the air. The Kimchi lactic acid bacteria culture 400 is coated on the blades and a frame for covering the blades and inducing the air flow, or injected in injection molding of the blades and the frame to be contained in the blades and the frame. The passage partition walls 441 are formed from both ends of the ventilator 440 to both ends of a discharge hole discussed later and from the top to bottom ends of the housing 430, for preventing mutual interferences between the air sucked into the ventilator 440 and the air serif by the ventilator 440. The Kimchi lactic acid bacteria culture 400 can be coated on the inner and outer surfaces of the passage partition walls 441, or injected in injection molding of the passage partition walls 441 to be contained in the passage partition walls 441. The purifiers 450 are detachably installed at both sides of the housing 430. Each of the purifiers 450 includes a casing 451, a dust collection filter 452, a deodorization filter 453, an antibacterial filter 454 and a Kimchi lactic acid bacteria culture filter 410. The casings 451 are formed in a box shape with their top surfaces opened, and inserted or separated through the openings formed at both sides of the front portion of the housing 430. The plurality of filters are laminated inside the casings 451 in the vertical direction to the air inflow direction. The Kimchi lactic acid bacteria culture 400 can be coated on the inner and outer surfaces of the casings 451, or injected in injection molding of the casings 451 to be contained in the casings 451. The dust collection filters 452 are made of net-shaped boards to filter off relatively large alien substances such as dust from the sucked air. The Kimchi lactic acid bacteria culture 400 is coated on the dust collection filters 452, or injected in injection molding of the dust collection filters 452 to be contained in the dust collection filters 452. The deodorization filters 453 filter off relatively small alien substances such as odor particles from the sucked air. The deodorization filters 453 are installed inside the dust collection filters 452 with a predetermined interval. The antibacterial filters 454 are coated with an antibacterial agent, for adsorbing bacteria from the sucked air or sterilizing the sucked air. The antibacterial filters 454 are installed inside the deodorization filters 453 with a predetermined interval. The Kimchi lactic acid bacteria culture filters 410 are coated with the Kimchi lactic acid bacteria culture 400 or contain the Kimchi lactic acid bacteria culture 400, for sterilizing the sucked air or restricting propagation of bacteria in the sucked air. The Kimchi lactic acid bacteria culture filters 410 are installed inside the antibacterial filters 454 with a predetermined interval. The suction grills 460 are formed in a plate shape to cover suction holes formed at both sides of the housing 430, and also formed in a net shape to filter off alien substances such as dust from the sucked air. The Kimchi lactic acid bacteria culture 400 can be coated on the suction grills 460, or injected in injection molding of the suction grills 460 to be contained in the suction grills 460. The discharge grill 470 covers the front surface of the discharge hole formed on the front surface of the housing 430. A plurality of blades are rotatably installed on the discharge grill 470, for controlling the direction of the air flow sent by the ventilator 440 and discharged through the discharge hole. The Kimchi lactic acid bacteria culture 400 can be coated on the blades and frame of the discharge grill 470, or injected in injection molding of the discharge grill 470 to be contained in the discharge grill 470. In this embodiment, the purifiers 450 are inserted or separated through the openings formed at both sides of the front surface of the housing 430. However, the plurality of filters can be fixed directly to the housing 430. In addition, the purifiers 450 can be inserted or separated through the suction holes formed at both sides of the housing 430.

The operation of the sterilization air freshener or air cleaner of the refrigerator in accordance with the present invention will now be described.

As the air freshener 420 of the refrigerator 410 is operated, the ventilator 440 installed at the center of the housing 430 of the air freshener 420 pressurizes and sends the air to the forward direction. By the operation of the ventilator 440, the air existing at both sides of the ventilator 440 is sucked into the ventilator 440, and pressurized and sent to the forward direction of the ventilator 440. As the air existing at both sides of the ventilator 440 is sucked into the ventilator 440, the air pressure is reduced at both sides of the ventilator 440. The outdoor air existing at both sides of the housing 430 with a relatively high air pressure is sucked into the air freshener 420 through both side suction holes of the housing 430. Here, the air sucked through the both side suction holes of the housing 430 is sterilized in contact with the Kimchi lactic acid bacteria culture 400 of the suction grills 460 installed on the suction holes. Bacteria cannot stick to the suction grills 460 to propagate themselves. The air sucked through the suction holes is purified through the filters of the purifiers 450 installed at both sides of the housing 430, and transferred to the ventilator 440. Here, the dust collection filters 452 of the purifiers 450 filter off dust from the sucked air, the deodorization filters 453 filter off odor particles, and the antibacterial filters 454 sterilize the air or adsorb general bacteria. The air purified by the filters is sterilized through the Kimchi lactic acid bacteria culture filters 410. The air purified by the purifiers 450 flows to both sides of the ventilator 440 inside the purifiers 450. The air flowing to both sides of the ventilator 440 is sucked into the ventilator 440 and sent to the forward direction of the ventilator 440 by the continuous operation of the ventilator 440. The air sent to the forward direction of the ventilator 440 flows to the discharge hole formed on the front surface of the housing 430. Thereafter, the air is externally discharged from the air freshener 420 under the direction control of the discharge grill 470 installed on the discharge hole. Here, the air sucked into the ventilator 440 is sterilized in contact with the Kimchi lactic acid bacteria culture 400 contained in the blades and frame of the ventilator 440. Bacteria cannot stick to the blades and the frame to propagate themselves. In addition, the Kimchi lactic acid bacteria culture 400 is contained in the passage partition walls 411 contacting the air sent by the ventilator 440 or sucked into the ventilator 440, for sterilizing the air and preventing adhesion and propagation of bacteria. The air discharged through the discharge grill 470 is sterilized in contact with the Kimchi lactic acid bacteria culture 400 contained in the discharge grill 470. Therefore, bacteria cannot stick to the discharge grill 470 to propagate themselves. That is, the air sucked into the air freshener 420 is sterilized in contact with the suction grills 460, the purifiers 450, the ventilator 440, the discharge grill 470 and the inner surface of the housing 430. Accordingly, the purified air can be externally discharged from the air freshener 420. Bacteria cannot stick to the suction grills 460, the purifiers 450, the ventilator 440, the discharge grill 470 and the inner surface of the housing 430 to propagate themselves. As a result, the bacteria propagated in the housing 430 and the inner components thereof are not externally discharged from the air freshener 420 by the air flow.

The method of performing the Kimchi lactic acid bacteria culture treatment and the Kimchi lactic acid bacteria culture exposure treatment in accordance with the present invention will now be described in detail.

The Kimchi lactic acid bacteria culture fluids acquired through various routes can be used without special restrictions, so far as they have the antibacterial and antivirus effects. For example, the Kimchi lactic acid bacteria culture fluid can be directly extracted from Kimchi, extracted from the cultivated Kimchi lactic acid bacteria, or purchased in a market. Any publicly-known method can be used to cultivate and extract the Kimchi lactic acid bacteria without special restrictions.

In addition, any phases of Kimchi lactic acid bacteria culture fluids can be used without special restrictions, so far as they have the antibacterial and antivirus effects. For example, the Kimchi lactic acid bacteria culture fluid can be selected from the group consisting of the Kimchi lactic acid bacteria culture fluid itself, a concentrate of the Kimchi lactic acid bacteria culture fluid, a dry matter of the Kimchi lactic acid bacteria culture fluid, and mixtures thereof. Any publicly-known method can be used to concentrate and dry the Kimchi lactic acid bacteria culture fluid without special restrictions.

Preferably, the Kimchi lactic acid bacteria are selected from the group consisting of *Leuconostoc* sp. Kimchi lactic acid bacteria, *Lactobacillus* sp. Kimchi lactic acid bacteria, *Weissella* sp. Kimchi lactic acid bacteria, and mixtures thereof.

Preferably, the *Leuconostoc* sp. Kimchi lactic acid bacteria are selected from the group consisting of *Leuconostoc citreum, Leuconostoc lactis, Leuconostoc mesenteroides* subsp. *dextranicum, Leuconostoc mesenteroides* subsp. *mesenteroides, Leuconostoc argentinum, Leuconostoc carnosum, Leuconostoc gellidum, Leuconostoc kimchii, Leuconostoc inhae, Leuconostoc gasicomitatum*, and mixtures thereof. More preferably, the *Leuconostoc* sp. Kimchi lactic acid bacteria are selected from the group consisting of *Leuconostoc citreum, Leuconostoc kimchii, Leuconostoc mesenteroides*, and mixtures thereof.

Preferably, the *Lactobacillus* sp. Kimchi lactic acid bacteria are selected from the group consisting of *Lactobacillus brevis, Lactobacillus acidophilus, Lactobacillus bulgaricus, Lactobacillus plantarum, Lactobacillus kimchii, Lactobacillus para-plantarum, Lactobacillus curvatus* subsp. *curvatus, Lactobacillus sakei* subsp. *sakei*, and mixtures thereof.

Preferably, the *Weissella* sp. Kimchi lactic acid bacteria are selected from the group consisting of *Weissella koreensi, Weissella hanii, Weissella kimchii, Weissella soli, Weissella confusa*, and mixtures thereof.

A. Method of Coating the Kimchi Lactic Acid Bacteria Culture

The method of coating the Kimchi lactic acid bacteria culture coats the Kimchi lactic acid bacteria culture on a surface of an article. In accordance with the present invention, the Kimchi lactic acid bacteria culture can be coated singly or in combination with a binder and/or nano metal particles.

The article is one of various articles which bacteria, viruses, etc. may contact to propagate themselves. For example, thermoplastic resin, thermosetting resin, rubber and metal can be used as the raw materials. The raw materials can be used in various ways according to their characteristics. The article can be a filter. Any article performing the filtering function can be used without special restrictions in use, kind and type. Exemplary articles include an air filter, a water filter and a cleaner filter. Any kinds of materials having the filtering function can be used as a material of the filter without special restrictions in kind, type, size and manufacturing process. Exemplary materials include a glass fiber, an ion exchange fiber, a cellulose fiber and an asbestos fiber, various organic and inorganic fibers, a metal such as zinc, copper and aluminum, and a plastic. Such materials can be variously used depending on their characteristics. The type of the filter can be appropriately modified depending on an apparatus using the filter without special restrictions, such as honeycomb type, grain type, net type, filter paper type, cotton type, mesh type, plate type and foam type. In accordance with the present invention, the filter can be used singly or in combination with the existing filter in the same product. Also, the article can be an air filter. Any article performing the air filtering function can be used as the air filter without special restrictions in kind, type, size and manufacturing process. Also, the type of the air filter can be appropriately modified depending on an apparatus using the filter without special restrictions. In accordance with the present invention, the air filter can replace a deodorization filter such as an activated charcoal filter, an aluminum mesh filter, a carbon filter, and a HEPA filter which are used in various electric home appliances such as a refrigerator, an air conditioner and an air freshener, and a filter of an air purifier of a vehicle, or can be used in combination with the existing filters.

In accordance with the present invention, the Kimchi lactic acid bacteria can be used with a binder. Silicone modified acryl resin, urethane resin, acryl resin and silicone resin can be used as the binder, which is not intended to be limiting. That is, various kinds of binders can be employed. In the case that the Kimchi lactic acid bacteria are not singly used but used with the binder, the binder serves to easily fix the Kimchi lactic acid bacteria to the surface of the article, and improve the inter-coupling action between the surface of the article needing the antimicrobial property and the Kimchi lactic acid bacteria. As a result, the binder reduces the elution rate of the Kimchi lactic acid bacteria, and maintains the antimicrobial performance.

In accordance with the present invention, any kinds of metal particles having a sterilizing function can be used as the nano metal particles without special restrictions. Exemplary metal particles include Ag, Zn, Cu, Pt, Cd, Pd, Rh and Cr particles. The metal particles can be singly or mixedly used. The nano metal particles mean metal particles made in a nano size. Any kinds of metal particles made in a nano size can be used without special restrictions in manufacturing process. The nano metal particles prevent propagation of microorganisms such as bacteria, fungi, etc, by restricting the reproduction function of the microorganisms, and interrupt the metabolism of the microorganisms by infiltrating into cells and stopping the enzyme function required in respiration, thereby performing sterilization. In the viewpoint of the antibacterial property and harmlessness to the environment and human body, the nano metal particles are preferably Ag, Zn and Cu nano metal particles, more preferably, nano Ag. Especially, the nano Ag can improve the efficiency of the Kimchi lactic acid bacteria culture fluid.

In accordance with one aspect of the present invention, the Kimchi lactic acid bacteria culture fluid can be singly coated on the surface of the article, for giving the antimicrobial property. In accordance with another aspect of the present invention, both the Kimchi lactic acid bacteria culture fluid and the nano metal particles can be coated on the surface of the article, for giving the antimicrobial property. Expected is the synergy of the Kimchi lactic acid bacteria culture fluid with the antibacterial and antivirus effects and the nano metal particles with the antibacterial function. According to the characteristic of the article, the characteristic of the manufacturing process, and the necessity of the antimicrobial property, the Kimchi lactic acid bacteria culture fluid can be used singly or in combination with the nano metal particles. Preferably, 5 to 20 wt % of Kimchi lactic acid bacteria culture fluid and 100 to 2000 ppm of nano metal particles are coated on the surface of the article. This range semi-permanently gives the antimicrobial property to the surface of the article in consideration of the antibacterial and antivirus effects over 99%, the coating characteristic and the mixing characteristic. However, if necessary, it can be appropriately adjusted.

The step for coating the surface of the article with the Kimchi lactic acid bacteria culture fluid, or the Kimchi lactic acid bacteria culture fluid and the nano metal particles can be performed according to a general method in the field to which the present invention pertains. Any kinds of methods which can evenly coat the surface of the article can be used.

When the Kimchi lactic acid bacteria culture fluid is singly coated, the Kimchi lactic acid bacteria culture fluid can be coated directly on the surface of the article. An appropriate fixation technique can be chemically or mechanically used to fix the Kimchi lactic acid bacteria culture fluid to the surface of the article. In addition, a method of preparing a coating solution containing the Kimchi lactic acid bacteria culture fluid, and spraying the coating solution to the surface of the article or dipping the article in the coating solution can be used to coat the surface of the article. The coating solution can be water or ethanol, which is not intended to be limiting. Any solution containing the Kimchi lactic acid bacteria culture fluid at an appropriate amount and giving the antimicrobial property to the surface of the article by coating can be used as the coating solution without special restrictions in kind and manufacturing process. The publicly-known spraying method such as air spray can be used, which is not intended to be limiting. Any kinds of methods which can evenly coat the surface of the article can be employed. In addition, the general dipping method can be used without special restrictions. Preferably, the amount of the Kimchi lactic acid bacteria culture fluid ranges from 5 to 20 wt %, which is not intended to be limiting. If necessary, the amount of the Kimchi lactic acid bacteria culture fluid can be appropriately adjusted.

Alternatively, in the case that the Kimchi lactic acid bacteria culture fluid and the nano metal particles are coated together, the Kimchi lactic acid bacteria culture fluid and the nano metal particles can be sequentially coated on the surface of the target article. According to the sequential coating process, the nano metal particles is coated on the surface of the article, and then the Kimchi lactic acid bacteria culture fluid is coated on the surface of the article coated with the nano metal particles. The step for coating the nano metal particles on the surface of the article can be performed according to a method publicly known in this field. If necessary, the nano metal particles can be modified for easy coating depending on the characteristic of the article. In addition, the step for coating the Kimchi lactic acid bacteria culture fluid on the surface of the article coated with the nano metal particles can be performed according to a method generally used in this field without special restrictions. A chemical or mechanical method can be appropriately used to fix the Kimchi lactic acid bacteria to the article coated with the nano metal particles. Any method of evenly coating the surface of the article, such as spraying and dipping can be used for coating. Conversely, it is possible to be coated with the Kimchi lactic acid bacteria culture fluid first, and coated with the nano metal particles on the surface of the article coated with the Kimchi lactic acid bacteria culture fluid. It is also possible to prepare a coating solution containing the Kimchi lactic acid bacteria culture fluid and the nano metal particles by mixing the two substances, and coat the coating solution on the surface of the article by spraying or dipping. Any method of preparing the coating solution can be employed without special restrictions, so far as the Kimchi lactic acid bacteria culture fluid and the nano metal particles can be coated on the surface of the article to give the antimicrobial property. Preferably, the amount of the Kimchi lactic acid bacteria culture fluid ranges from 5 to 20 wt %, and the content of the nano metal particles ranges from 100 to 2000 ppm. This range semipermanently gives the antimicrobial property to the surface of the article in consideration of the antibacterial and antivirus effects over 99%, the coating characteristic and the mixing characteristic. However, if necessary, this range can be appropriately adjusted.

Further, in accordance with the present invention, in the case that the Kimchi lactic acid bacteria culture fluid is coated on the surface of the article, the Kimchi lactic acid bacteria culture fluid can be mixed with the binder before the coating step. The binder improves the inter-coupling action between the surface of the article and the Kimchi lactic acid bacteria culture fluid, and reduces the elution rate of the Kimchi lactic acid bacteria culture fluid, thereby maintaining the antimicrobial performance. Accordingly, it is more advantageous to mix the Kimchi lactic acid bacteria culture fluid with the binder than to singly use the Kimchi lactic acid bacteria culture fluid. Any method of mixing the Kimchi lactic acid bacteria culture fluid with the binder can be used without special restrictions, so far as the Kimchi lactic acid bacteria culture fluid can be coated on the surface of the article. The content ratio of the Kimchi lactic acid bacteria culture fluid to the binder is not specially restricted but appropriately adjusted. If necessary, an inorganic pigment can be added.

In accordance with one embodiment of the present invention, the coating solution containing the Kimchi lactic acid bacteria culture fluid and the nano metal particles was prepared, and spray-coated on an aluminum mesh filter, thereby obtaining the filter with the antimicrobial property. In one experiment of the present invention, *Escherichia coli, Staphylococcus aureus* and *Pseudomonas aeruginosa* were used to test the antibacterial activity of the filter with the antimicrobial property. As a result, the filter with the antimicrobial property showed excellent antibacterial activity to *Escherichia coli, Staphylococcus aureus* and *Pseudomonas aeruginosa*. In another experiment of the present invention, H5N1, which was an avian influenza virus, was used to test the antivirus activity of the filter. As a result, the filter showed a high virus reduction rate.

On the other hand, the manufacturing method can further include a step for washing the target article with proper wash water, and a step for drying the article by a thermal treatment after the washing, prior to coating the Kimchi lactic acid bacteria culture fluid on the surface of the article. In addition, the manufacturing method can further include a step for drying the article naturally or by a thermal treatment after coating the Kimchi lactic acid bacteria culture fluid on the surface of the article. The thermal treatment serves to fix the Kimchi lactic acid bacteria culture fluid and the nano metal particles to the surface of the article. A drying time and a drying temperature of the article are adjustable according to the shape, kind and size of the article. In case the target article is made of metal, it is advantageous to remove oil elements sticking to the surface of the article in the manufacturing or keeping process.

In accordance with the present invention, if necessary, the manufactured article can be post-processed into a wanted shape and appropriately used. Especially, the air filter can be cut into a wanted size and used as a filter of an air purifier. The air filter can be used singly or in combination with the existing air filter and deodorization filter in the same product. The air filter can be applied to various air purifiers for home or business use, refrigerators, vehicles, and other electric home appliances.

B. Method of Molding Kimchi Lactic Acid Bacteria Culture

Molding of the Kimchi lactic acid bacteria culture is carried out by manufacturing a molded article by using the Kimchi lactic acid bacteria culture singly or in combination with the nano metal particles.

In accordance with the present invention, the article can be molded by combining the Kimchi lactic acid bacteria culture fluid or both the Kimchi lactic acid bacteria culture fluid and the nano metal particles with a raw material. Any kinds of raw materials which can form the shape of the article, preferably, the whole electric home appliance or the parts thereof can be used without special restrictions. For example, thermoplastic resin, thermosetting resin, rubber and metal can be used as the raw materials. The raw materials can be used in various ways according to their characteristics. Exemplary raw materials include polymers such as silicone, polyurethane, polyethylene, polypropylene (PP), polyvinylchloride (PVC), latex, acrylonitrile butadiene styrene (ABS), polytetrafluoroethylene (PTFE), polycarbonate (PC) and polyvinylalcohol (PVA). The raw materials can be singly or mixedly used.

In accordance with the present invention, the Kimchi lactic acid bacteria culture fluid or both the Kimchi lactic acid bacteria culture fluid and the nano metal particles are not uniformly distributed but distributed with a different content ratio in the molded article. For this, the article can be manufactured with the portion containing the Kimchi lactic acid bacteria culture fluid or both the Kimchi lactic acid bacteria culture fluid and the nano metal particles, and the portion containing the Kimchi lactic acid bacteria culture fluid or both the Kimchi lactic acid bacteria culture fluid and the nano metal particles in a lower or no content, by additionally performing an appropriate operation publicly known in this field in the molding step. In general, bacteria or viruses may contact to proliferate highly in the portion of the article that directly meets a medium such as the air and water in which bacteria and viruses are floating. Thus, it is such a portion of the article that needs the antimicrobial property. For this, it is necessary to intensively treat the portion of the article requiring the antimicrobial property with the Kimchi lactic acid bacteria culture fluid. As a result, the same amount of Kimchi lactic acid bacteria culture fluid can improve the substantial antimicrobial effect. For example, the molded article with the antimicrobial property can be manufactured by extrusion or injection-molding one layer by combining the Kimchi lactic acid bacteria culture fluid or the Kimchi lactic acid bacteria culture fluid and the nano metal particles with the raw material, extrusion or injection-molding another layer by combining the Kimchi lactic acid bacteria culture fluid or the Kimchi lactic acid bacteria culture fluid and the nano metal particles with the raw material in a lower content, and jointing the molded layers. In addition, the molded article with the antimicrobial property can be manufactured by extrusion or injection-molding one layer by combining the Kimchi lactic acid bacteria culture fluid or the Kimchi lactic acid bacteria culture fluid and the nano metal particles with the raw material, extrusion or injection-molding another layer by using the raw material without adding the Kimchi lactic acid bacteria culture fluid or the nano metal particles, and jointing the molded layers. To distribute the Kimchi lactic acid bacteria culture fluid in a different content in a single layer instead of jointing layers, the molded article with the antimicrobial property can be manufactured by combining the Kimchi lactic acid bacteria culture fluid or the Kimchi lactic acid bacteria culture fluid and the nano metal particles with the raw material (raw material 1), combining the Kimchi lactic acid bacteria culture fluid or the Kimchi lactic acid bacteria culture fluid and the nano metal particles with the raw material in a lower content (raw material 2), and individually implanting the raw materials 1 and 2 by performing an appropriate operation in the extrusion or injection molding. Generally, bacteria or viruses may contact to proliferate highly in the portion of the article that directly meets a medium such as the air and water in which bacteria and viruses are floating. Thus, it is such a portion of the article that needs the antimicrobial property. For this, it is necessary to intensively treat the portion of the article requiring the antimicrobial property with the Kimchi lactic acid bacteria culture fluid, by diversifying the content of the Kimchi lactic acid bacteria culture fluid, instead of uniformly combining the Kimchi lactic acid bacteria culture fluid with the raw material and evenly distributing the Kimchi lactic acid bacteria culture fluid on the whole article in the molding. As a result, the same amount of Kimchi lactic acid bacteria culture fluid can improve the substantial antimicrobial effect.

The step for molding the article by combining the Kimchi lactic acid bacteria culture fluid or the Kimchi lactic acid bacteria culture fluid and the nano metal particles with the raw material can be carried out according to a method generally used in this field. Any method which can form the shape of the article can be used without special restrictions. Exemplary molding methods include extrusion molding and injection molding. Since the Kimchi lactic acid bacteria culture fluid is combined with the raw material in the molding step of the article, the manufacturing time is reduced and the manufacturing process is simplified.

When the Kimchi lactic acid bacteria culture fluid is singly combined with the raw material, any combination method which can form the shape of the article can be used without special restrictions. The combination ratio of the Kimchi lactic acid bacteria culture fluid to the raw material is not specially restricted but appropriately adjusted. Preferably, the amount of the Kimchi lactic acid bacteria culture fluid ranges from 5 to 20 wt %, which is not intended to be limiting. If necessary, such a range can be appropriately adjusted.

Alternatively, when the Kimchi lactic acid bacteria culture fluid and the nano metal particles are combined with the raw material, any combination method which can form the shape of the article can be used without special restrictions. The combination ratio thereof is not specially restricted but appropriately adjusted. Preferably, the amount of the Kimchi lactic acid bacteria culture fluid ranges from 5 to 20 wt %, and the content of the nano metal particles ranges from 100 to 2000 ppm to improve the antimicrobial performance, combination characteristic and molding characteristic. However, if necessary, such ranges are appropriately adjustable.

In addition, the Kimchi lactic acid bacteria culture fluid can be encapsulated before the combination with the raw material, and then combined with the raw material. The encapsulation of the Kimchi lactic acid bacteria culture fluid prevents the Kimchi lactic acid bacteria culture fluid from being degenerated at a high temperature in the molding step of the article. Accordingly, the article can be molded at a relatively high temperature. The capsule consists of a core material and a wall material. The core material includes an objective material such as an antibacterial agent, a deodorant agent and an aromatic agent, and the wall material includes micro or nano size grains by forming a thin film with synthetic or natural polymers. Any material which can contain the Kimchi lactic acid bacteria culture fluid can be used as the wall material without special restrictions. Exemplary wall materials include melamine, polyurethane, gelatin, acryl, epoxy, starch, alginate, Chitosan, and mixtures thereof. The encapsulation can be performed according to a method generally used in this field without special restrictions. Once the Kimchi lactic acid bacteria culture fluid is encapsulated, the Kimchi lactic acid bacteria culture fluid is not degenerated at a high molding temperature of the article. The wall material of the capsule is dissolved or burst at a predetermined time after the molding, to spread the Kimchi lactic acid bacteria culture fluid on the whole article. As a result, the antimicrobial effect can be more improved. The encapsulation of the Kimchi lactic acid bacteria culture fluid can be performed according to a method generally used in this field without special restrictions. The molding temperature is not specially restricted but appropriately adjusted according to the characteristic of the raw material of the article. In consideration of the degeneration of the Kimchi lactic acid bacteria culture fluid, preferably, the molding temperature ranges from 100 to 180° C. In the case that the Kimchi lactic acid bacteria culture fluid is encapsulated, degeneration possibility due to the temperature is lowered. As a result, the molding temperature can be raised, for example, to 100 to 250° C.

On the other hand, the manufacturing method can include additional processing steps, such as a drying step and a hardening step after combining the Kimchi lactic acid bacteria culture fluid with the raw material and molding the article. When the article is dried, a drying time and a drying temperature can be adjusted according to the shape, kind and size of the article. If necessary, the molded article can be post-processed into a wanted shape and appropriately used.

The present invention will now be explained by the following examples. Such examples are not intended to be limiting.

EXAMPLE 1

An aluminum mesh made by Airphil corporation was immersed into 2.5% NaOH solution for about 3 minutes, to remove oil components. Then, the oil removed-aluminum mesh was washed with 2.5% NaOH solution. The washing step was repeated 7 times. A thermal treatment was performed on the washed aluminum mesh by drying in a dry oven at a temperature of 40° C. for 2 hours.

EXAMPLE 2

10 g of dry powder of culture fluid of *Leuconostoc* citreum selected from the *Leuconostoc* sp. Kimchi lactic acid bacteria was mixed with 15 g of silicone modified acryl resin binder, 3 g of nano zinc, 1 g of nano silver and 0.5 g of nano copper, and dissolved in a water as a solvent, thereby preparing a coating solution containing Kimchi lactic acid bacteria culture fluid. The coating solution was air-sprayed on the aluminum mesh prepared in Example 1 and then the coated aluminum mesh was dried. Obtained was an aluminum mesh filter sample coated with the Kimchi lactic acid bacteria culture fluid and the nano metal particles.

TEST EXAMPLE 1

Antibacterial Property Test

The antibacterial property of the aluminum mesh coated with the Kimchi lactic acid bacteria culture fluid in Example 2 was tested according to a shake flask method (KS M 0146-2003) by using *Escherichia coli* (ATCC 25922), *Staphylococcus aureus* (ATCC 6538) and *Pseudomonas aeruginosa* (ATCC 27853).

1 ml of *Escherichia coli* culture, *Staphylococcus aureus* culture and *Pseudomonas aeruginosa* culture were respectively coated on the aluminum mesh filter samples (1.0 cm×1.0 cm) prepared in Example 2, respectively. The aluminum mesh filter samples coated with each strain culture were immersed into a Erlenmeyer flask containing LB broth, and shake incubated at 35±1° C. in 120 rpm for 3 hours. For comparison, 1 ml of each strain culture was inoculated into a Erlenmeyer flask containing LB broth, and shake incubated in the same condition. The incubated cell cultures were taken up to spread on a LB plate, and incubated at 37° C. for 48 hours. The colonies of each bacteria were counted. The results are shown in the following Tables 1 to 3.

TABLE 1

| Strain | Sample | Initial (cfu/ml) | 1 hr (cfu/ml) | 2 hrs. (cfu/ml) | 3 hrs. (cfu/ml) | Suppression rate (%) |
|---|---|---|---|---|---|---|
| *E. coli* | Example 2 | $1.5 \times 10^5$ | <10 | <10 | <10 | >99.9 |
| | Comparison | $1.5 \times 10^5$ | $1.6 \times 10^5$ | $1.7 \times 10^5$ | $2.0 \times 10^5$ | |

*cfu/ml: colony formation unit per ml

TABLE 2

| Strain | Sample | Initial (cfu/ml) | 1 hr (cfu/ml) | 2 hrs. (cfu/ml) | 3 hrs. (cfu/ml) | Suppression rate (%) |
|---|---|---|---|---|---|---|
| *S. aureus* | Example 2 | $1.3 \times 10^5$ | <10 | <10 | <10 | >99.9 |
| | Comparison | $1.3 \times 10^5$ | $1.5 \times 10^5$ | $1.8 \times 10^5$ | $2.2 \times 10^5$ | |

*cfu/ml: colony formation unit per ml

TABLE 3

| Strain | Sample | Initial No. (cfu/ml) | 1 hr (cfu/ml) | 2 hrs. (cfu/ml) | 3 hrs. (cfu/ml) | Suppression rate (%) |
|---|---|---|---|---|---|---|
| *P. aeruginosa* | Example 2 | $1.2 \times 10^5$ | <10 | <10 | <10 | >99.9 |
| | Comparison | $1.2 \times 10^5$ | $1.4 \times 10^5$ | $1.7 \times 10^5$ | $2.2 \times 10^5$ | |

*cfu/ml: colony formation unit per ml

As known from the above Tables 1 to 3, as compared with the comparisons, the aluminum mesh filter coated with the Kimchi lactic acid bacteria culture fluid has excellent antibacterial activity to microorganisms, such as *Escherichia coli, Staphylococcus aureus* and *Pseudomonas aeruginosa.*

TEST EXAMPLE 2

Antivirus Property Test

A coating solution containing Kimchi lactic acid bacteria culture fluid was prepared and sprayed on surfaces of an aluminum mesh filter, a carbon filter and a HEPA filter, respectively, thereby obtaining three kinds of filter samples coated with the Kimchi lactic acid bacteria culture fluid. The antivirus property test was performed on each filter.

Avian influenza virus H5N1 isolate was used to test the antivirus effect of the Kimchi lactic acid bacteria culture fluid. Mardin-Darby Canine Kidney (MDCK) cell lines from dog kidney cells were used as host cells of viruses.

First, 100 $\mu\ell$ of MDCK cells ($5\times10^4$ cells/ml) were seeded onto each well of a 96-well plate, and incubated in 5% $CO_2$ incubator at 37° C. for 24 hours, so that the cells could cover the bottoms of the wells in a monolayer shape. A virus solution (1/10 v/v) diluted with PBS was added to each well containing the three kinds of samples (aluminum mesh filter, carbon filter and HEPA filter, respectively) coated with the Kimchi lactic acid bacteria culture fluid, and incubated at 37° C. For comparison, the virus solution was incubated in the same manner in regard to the same three samples which were not coated with the Kimchi lactic acid bacteria culture fluid. The weight of each sample was recorded before addition of the virus solution. A culture inoculated with the virus solution and a culture which was not inoculated with the virus solution were prepared for a positive comparison and a negative comparison to the viral cytopathic effect (vCPE), respectively.

In order to test the antivirus effect, the 10-times diluted culture for the aluminum filter sample coated with the Kimchi lactic acid bacteria culture fluid, the aluminum filter sample which was not coated with the Kimchi lactic acid bacteria culture fluid, and the positive comparison was inoculated into the seven rows of the 96-well plates in quadruple. And the culture for the negative comparison was inoculated into the final eighth row. After the inoculation, the plates were incubated in 5% $CO_2$ incubator at 37° C. for 3 days. The vCPE of the plate was observed, and the virus titer was determined as $TCID_{50}$ (50% tissue culture infective dose). The antivirus effect was represented by a virus reduction rate (%). Here, the virus reduction rate was a percentage value of log $TCID_{50}$/ml converted by using a value obtained by subtracting the weight of the sample which was not coated with the Kimchi lactic acid bacteria culture fluid from the weight of the sample coated with the Kimchi lactic acid bacteria culture fluid. The results are shown in the following Tables 4 to 6.

TABLE 4

| | Virus titer ($TCID_{50}$/ml) | Coated Al mesh filter (g) | Non-coated Al mesh filter (g) | Virus reduction rate (%) |
|---|---|---|---|---|
| 30 minutes | 6.25 | 0.1132 | 0.0946 | 99.92 |
| 1 hour | 6.50 | 0.1091 | 0.0871 | >99.99 |
| 2 hours | 6.27 | 0.0999 | 0.0809 | >99.99 |
| 4 hours | 6.25 | 0.1195 | 0.0872 | >99.99 |
| 8 hours | 5.75 | 0.1175 | 0.0806 | 99.99 |

TABLE 5

| | Virus titer ($TCID_{50}$/ml) | Coated C filter (g) | Non-coated C filter (g) | Virus reduction rate (%) |
|---|---|---|---|---|
| 30 minutes | 6.75 | 0.3194 | 0.2720 | 99.90 |
| 1 hour | 6.50 | 0.3240 | 0.2743 | 99.84 |
| 2 hours | 6.00 | 0.3196 | 0.2635 | >99.99 |
| 4 hours | 5.75 | 0.4346 | 0.2887 | 99.82 |

TABLE 6

| | Virus titer ($TCID_{50}$/ml) | Coated HEPA filter (g) | Non-coated HEPA filter (g) | Virus reduction rate (%) |
|---|---|---|---|---|
| 30 minutes | 6.00 | 0.0820 | 0.0614 | 98.22 |
| 1 hour | 5.75 | 0.0848 | 0.0678 | 99.82 |
| 2 hours | 6.50 | 0.0545 | 0.0514 | 99.94 |
| 4 hours | 6.25 | 0.0560 | 0.0486 | 99.99 |
| 8 hours | 5.75 | 0.0529 | 0.0461 | 99.99 |

As known from the above Tables 4 to 6, the aluminum mesh filter, the carbon filter and the HEPA filter coated with the Kimchi lactic acid bacteria culture fluid have the virus reduction rate almost over 99%, namely, the excellent antivirus effect.

The invention claimed is:

1. A refrigerator, comprising:

a refrigerating cycle having an evaporator;

a storage chamber for exchanging heat with the evaporator; and a door for opening and closing the storage chamber, wherein at least one of the storage chamber and the door has undergone at least one of a Kimchi lactic acid bacteria culture treatment and a Kimchi lactic acid bacteria culture exposure treatment, and wherein the Kimchi lactic acid bacteria culture exposure treatment is performed by at least one of installation of a filter and supply of a Kimchi lactic acid bacteria culture.

2. The refrigerator of claim 1, wherein the Kimchi lactic acid bacteria culture treatment is performed by at least one of coating of a Kimchi lactic acid bacteria culture and molding of a material containing a Kimchi lactic acid bacteria culture.

3. A refrigerator, comprising:

a refrigerating cycle having an evaporator;

a storage chamber for exchanging heat with the evaporator; and a door for opening and closing the storage chamber, wherein at least one of the storage chamber and the door has undergone at least one of a Kimchi lactic acid bacteria culture treatment and a Kimchi lactic acid bacteria culture exposure treatment, and wherein the region has undergone the Kimchi lactic acid bacteria culture treatment, and the region undergone by the Kimchi lactic acid bacteria culture treatment is the evaporator.

4. The refrigerator of claim 3, further comprising a fan used for heat exchange in the region.

5. The refrigerator of claim 3, further comprising a passage extended to the region and used for heat exchange.

6. The refrigerator of claim 5, further comprising a filter disposed on the passage.

7. The refrigerator of claim 1, wherein the storage chamber is delimited by an inner casing, and comprises at least one of a shelf, a basket, a food container and a drawer.

8. The refrigerator of claim 1, wherein the door comprises a door handle.

9. The refrigerator of claim 1, further comprising:

a variable temperature chamber disposed at the storage chamber with its inside temperature controllable;

a spray disposed toward the variable temperature chamber; and a container being connected to the spray and containing a Kimchi lactic acid bacteria culture.

10. The refrigerator of claim 9, wherein the storage chamber comprises a freezing chamber, the refrigerator including a damper disposed to communicate with the freezing chamber and the variable temperature chamber.

11. The refrigerator of claim 9, further comprising a heater used for controlling the inside temperature of the variable temperature chamber.

12. A refrigerator, comprising:

a refrigerating cycle having an evaporator;

a space for containing the cool air having a low temperature by exchanging heat with the evaporator; and at least one member which has undergone at least one of a Kimchi lactic acid bacteria culture treatment and a Kimchi lactic acid bacteria culture exposure treatment, the at least one member contacting water exchanging heat with the cool air of the space, wherein the Kimchi lactic acid bacteria culture exposure treatment is performed by installation of a filter.

13. The refrigerator of claim 12, wherein the Kimchi lactic acid bacteria culture treatment is performed by at least one of coating of a Kimchi lactic acid bacteria culture and molding of a material containing a Kimchi lactic acid bacteria culture.

14. A refrigerator, comprising:

a refrigerating cycle having an evaporator;

a space for containing the cool air having a low temperature by exchanging heat with the evaporator; and at least one member which has undergone at least one of a Kimchi lactic acid bacteria culture treatment and a Kimchi lactic acid bacteria culture exposure treatment, the at least one member contacting water exchanging heat with the cool air of the space, wherein the at least one member comprises an element for containing ice solidified when water exchanges heat with the cool air of the space.

15. The refrigerator of claim 14, wherein the at least one member further comprises a member for externally discharging the ice from the space.

16. A refrigerator, comprising:

a refrigerating cycle having an evaporator;

a space for exchanging heat with the evaporator;

a region for exchanging heat between the evaporator and the space; and an air freshener which has undergone at least one of a Kimchi lactic acid bacteria culture treatment and a Kimchi lactic acid bacteria culture exposure treatment, the air freshener being disposed at one side of the space, wherein the Kimchi lactic acid bacteria culture exposure treatment is performed by installation of a filter.

17. A refrigerator, comprising:

a refrigerating cycle having an evaporator;

a space for exchanging heat with the evaporator;

a region for exchanging heat between the evaporator and the space, an air freshener which has undergone at least one of a Kimchi lactic acid bacteria culture treatment and a Kimchi lactic acid bacteria culture exposure treatment, the air freshener being disposed at one side of the space; and a storage chamber and a door for defining the space, wherein at least one of the region, the storage chamber and the door has undergone at least one of the Kimchi lactic acid bacteria culture treatment and the Kimchi lactic acid bacteria culture exposure treatment.

* * * * *